US006071352A

United States Patent [19]

Sugie et al.

[11] Patent Number: 6,071,352

[45] Date of Patent: Jun. 6, 2000

[54] ERASING METHOD AND ERASING APPARATUS FOR PERFORMING THAT ERASING METHOD

[75] Inventors: Masaru Sugie; Chiaki Sekioka, both of Inagi; Yoshiaki Yanagida, Kawasaki; Hisashi Uemura, Inagi; Masayuki Kubota, Inagi; Hirobumi Haga, Inagi, all of Japan

[73] Assignee: Fujitsu Isotec Limited, Tokyo, Japan

[21] Appl. No.: 08/228,449

[22] Filed: Apr. 15, 1994

[30] Foreign Application Priority Data

Apr. 15, 1993 [JP] Japan ..... 5-088796
Oct. 22, 1993 [JP] Japan ..... 5-265253

[51] Int. Cl.[7] ..... B08B 3/12

[52] U.S. Cl. ..... 134/1; 134/41; 134/105; 430/345

[58] Field of Search ..... 134/1, 2, 41, 105; 430/345

[56] References Cited

U.S. PATENT DOCUMENTS 4,965,591 10/1990 Kurabayashi et al. ..... 364/108
5,164,287 11/1992 Nagae et al. ..... 430/345
5,234,799 8/1993 Nagae et al. ..... 430/345

FOREIGN PATENT DOCUMENTS 0 468 465 1/1992 European Pat. Off. .
0 523 705 1/1993 European Pat. Off. .
0 542 192 5/1993 European Pat. Off. .
41 32 288 4/1992 Germany .
5-127571 5/1993 Japan .
6-59500 3/1994 Japan .
6-175537 6/1994 Japan .

OTHER PUBLICATIONS

Japan Office Action for Japanese Application No. 5–265253, which Attorney for Applicants is advised is dated Dec. 10, 1998.

Database WPI Week 9325, Derwent Publications Ltd., London, GB; AN 93–200676 & JP–A–5 125323 (Mita Ind Co Ltd), May 21, 1993.

*Primary Examiner*—Scott Kastler
*Attorney, Agent, or Firm*—Staas & Halsey

[57] ABSTRACT

According to a first aspect of this invention, it is assumed that the recording is carried out on the recording medium by a non-catalyst-containing recording agent and a liquid-state catalyst is coated on the recording medium at the time of erasing processing and subsequently the heating and irradiation of near infrared rays are carried out as the erasing processing. Also, according to a second aspect of this invention, it is assumed that the recording is carried out on the recording medium by a catalyst-containing recording agent and, at the erasing processing time, the heating and irradiation of the recording agent are simultaneously carried out using a thermal emission and near IR irradiation source such as a halogen lamp.

60 Claims, 27 Drawing Sheets

ERASING METHOD AND ERASING APPARATUS FOR PERFORMING THAT ERASING METHOD

BACKGROUND OF THE INVENTION

1. Field of the Invention

The present invention relates to an erasing method of erasing a recording agent on a recording surface of a recording medium recorded by a recording agent composed of a near IR erasable dye, for example, an aqueous ink, an oily ink, toner, etc., and an erasing apparatus for performing that erasing method.

2. Description of the Related Art

In recent years, near IR erasable dyes have been coming under attention as dyes of the recording paper used in various printers, copying machines, etc. This is because a repeated reuse of the recording medium such as recording paper recorded by such a recording agent is possible, and this can contribute to the conservation of forest resources. As disclosed in for example Japanese Unexamined Patent Publication (Kokai) No. 4-362935, a near IR erasable dye is a complex compound of a near IR absorbing cationic dye—boron anion. This compound is decomposed by irradiation of near infrared rays (a wavelength of 700 nm or more) to become a transparent substance, but is a relatively stable compound under visible rays. Accordingly, it is possible to utilize the near IR erasable dye as a recording agent in various printers etc., for example, various dyes of inks and toners, whereby the recording agent on the recording paper can be decomposed and erased by the irradiation of the near infrared rays, therefore making reuse of the recording paper possible.

So as to achieve an enhancement of the efficiency of reuse of recording paper, it is necessary to quickly and effectively carry out processing for decomposition of the near IR erasable dye, that is, processing for erasing of the recording agent. The decomposition of the near IR erasable dye is promoted under the presence of an appropriate catalyst, for example, tetrabutyl ammonium butyl triphenyl borate. In the above-mentioned Japanese Unexamined Patent Publication (Kokai) No. 4-362935, as the recording agent composed of the near IR erasable dye and the catalyst (sensitizing agent), an ink or a toner has been proposed, and such a near IR erasable dye included in the recording agent is smoothly decomposed due to such a catalyst at the time of irradiation of near infrared rays, therefore a quick erasing processing of the recording agent, that is, an enhancement of efficiency of reuse of the recording paper, can be achieved.

Also, natural light or room light includes light having a wavelength of 700 nm or more, therefore where the recording paper recorded by a catalyst-containing recording agent is left to stand for a long period, the recording density on the recording paper, that is, the printing density, is gradually lowered due to the catalyst. Therefore, arises a problem on the point of persistency of such a recording paper. Moreover, it is pointed out that there is a problem that, where the printing density is once lowered in this way, even if the irradiation of near infrared rays is positively carried out to that recording agent, complete erasure cannot be carried out.

On the other hand, it is known also that the erasability of the recording agent as mentioned above is promoted under a high temperature, and therefore it is also proposed that the recording paper be heated at the time of erasing and that subsequently irradiation of the near infrared rays be carried out. In this case, both of the heating source for heating the recording paper and the near IR irradiation source become necessary. It goes without saying that the provision of both of the heating source and the near IR irradiation source leads to the result of an increase of production costs of the erasing apparatus.

SUMMARY OF THE INVENTION

Accordingly, a first object of the present invention is to provide an erasing technology for erasing the recording agent on a recording surface of a recording medium on which recording has been performed by a recording agent composed of a near IR erasable dye, with which the stabilization of the density of the recording agent on the recording medium for a long period is guaranteed to enhance the persistency of the recording medium and, at the same time, it becomes possible to substantially completely perform the erasing processing of the recording agent on the recording surface of the recording medium.

Also, a second object of the present invention is to provide an erasing technology for erasing the recording agent on a recording surface of a recording medium on which recording has been performed by a recording agent composed of a near IR erasable dye, in which it is not necessary to individually use both of the heating source and the near IR irradiation source at the time of erasing processing of the recording agent on the recording surface of a recording medium.

According to a first aspect by the present invention, it is assumed that the recording is carried out by a non-catalyst-containing recording agent composed of a near IR erasable dye for the recording medium, a liquid-state catalyst is coated there at the time of the erasing processing of the recording agent on the recording surface of recording medium, and subsequently the recording medium is heated and the near infrared rays are irradiated onto the liquid-state catalyst-coated surface of the recording medium.

Also, according to the second aspect by the present invention, it is assumed that the recording is carried out by a catalyst-containing recording agent composed of a near IR erasable dye for the recording medium, and the heating of the recording medium and the irradiation of the near infrared rays onto the recording surface of the recording medium are simultaneously carried out by the thermal emission and near IR irradiation source at the time of the erasing processing of the recording agent on the recording surface of recording medium.

According to the first aspect of the present invention, it is assumed that the recording is carried out on the recording medium by a non-catalyst-containing recording agent, and therefore the concentration of the recording agent of the recording surface can be stably maintained for a long period. Namely, the persistency of the recording medium for a long period can be guaranteed. On the other hand, the liquid-state catalyst is coated on the recording surface of the recording medium at the time of the erasing processing, and therefore the liquid-state catalyst is smoothly permeated through the whole recording agent, and therefore the recording agent on the recording surface of recording medium can be erased well by the heating and irradiation of near infrared rays.

Also, according to the second aspect of the present invention, the heating of the recording medium and the irradiation of the near infrared rays onto the recording surface of the recording medium are simultaneously carried out by the thermal emission and near IR irradiation source at the time of the erasing processing of the recording agent on the recording surface of recording medium, and therefore it is not necessary to individually provide the heating source and the near IR irradiation source.

BRIEF DESCRIPTION OF THE DRAWINGS

The above-mentioned object of the present invention, other object, and various advantages of the present invention will be clarified by the following disclosure referring to the attached drawings, in which.

DESCRIPTION OF THE PREFERRED EMBODIMENTS

Figure 1:
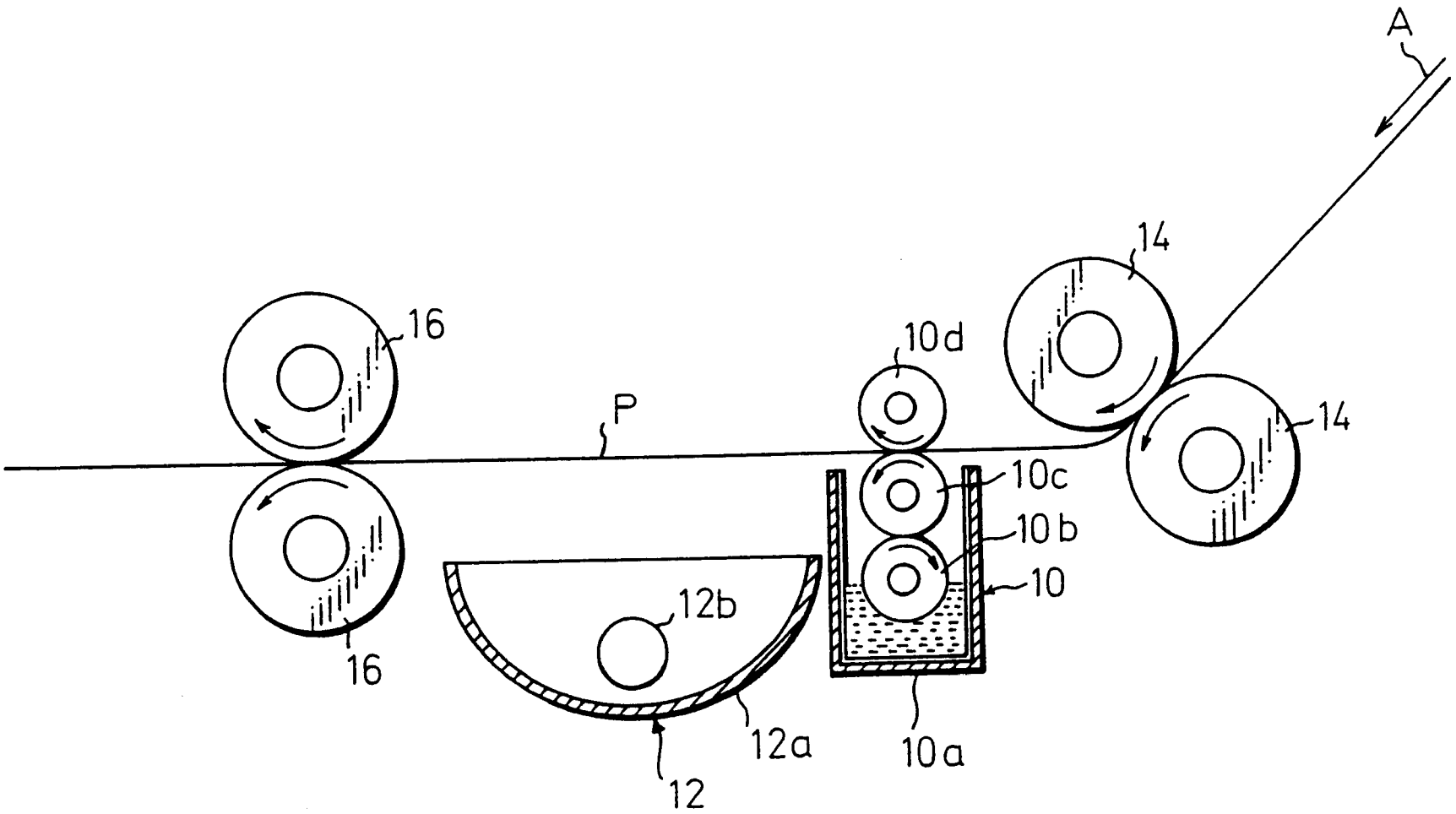
FIG. 1 is a schematic view showing the principle structure of an erasing apparatus for working the erasing method according to a first aspect of the present invention.

Referring to FIG. 1, there is shown the principle structure of an erasing apparatus for working an erasing method according to the first aspect of the present invention. This erasing apparatus is provided with a liquid-state catalyst coating unit 10; a heating and near IR irradiation unit 12 which is arranged adjoining this liquid-state catalyst coating unit 10; a pair of paper feed rollers 14 and 14 for supplying the recording medium such as a recording paper to the liquid-state catalyst coating unit 10; and a pair of sheet paper feeding rollers 16 and 16 arranged adjoining the heating and near IR irradiation unit. In FIG. 1, reference symbol P indicates a sheet paper passage of the recording medium such as a recording paper. A recording paper is introduced from a direction indicated by an arrow A via the paper feed rollers 14 and 14 into the liquid-state catalyst coating unit 10 and subsequently passes above the heating and near IR irradiation unit 12, and then is ejected from the erasing apparatus through the sheet paper feeding roller 16. Note that, at the time of operation of the erasing apparatus, the paper feed rollers 14 and 14 and sheet paper feeding rollers 16 and 16 are driven to rotate in directions shown in the figure, respectively. Note that, although not illustrated in FIG. 1, the sheet paper passage P is defined by appropriately arranging a guide plate.

The liquid-state catalyst coating means 10 comprises a retaining tank 10*a* for retaining the liquid-state catalyst and a roller assembly arranged inside this retaining tank 10*a*. The liquid-state catalyst retained inside the retaining tank 10*a* has a catalyst concentration preferably within a range of from about 0.5 to about 5 percent by weight. As the solvent, an alcohol, acetone, water, or the like is used. The roller assembly comprises a lower roller 10*b*, a middle roller 10*c*, and an upper roller 10*d*, which three rollers are aligned in a vertical direction. In addition, two adjoining rollers are brought into contact with each other. Note that, at the time of operation of the erasing apparatus, the rollers are driven to rotate in the direction indicated by the arrow in the figure. The lower roller 10*b* acts as a feeding roller of the liquid-state catalyst. Preferably, roughening is applied to the surface thereof so as to enhance the feeding property of the liquid-state catalyst. The middle roller 10*c* acts as a liquid-state catalyst coating roller, and the periphery thereof is covered by the liquid-state catalyst fed from the lower roller 10*b*. The upper roller 10*d* acts as a backup roller with respect to the middle roller 10*c*. The recording paper is made to pass between the middle roller 10*c* and the upper roller 10*d*, and at this time, the recording surface of recording medium, that is the recording agent retaining surface on which a recording is performed by the non-catalyst-containing recording agent composed of the near IR erasable dye is directed so as to come into contact with the middle roller 10*c*, whereby the recording agent on the recording paper is coated by the liquid-state catalyst.

The heating and near IR irradiation unit 12 comprises a reflecting concave surface mirror member 12*a* and a thermal emission and near IR irradiation source arranged at a focus of this reflecting concave surface mirror member 12*a*, for example, a halogen lamp 12*b*. The light obtained from such a halogen lamp 12*b* includes a lot of near infrared rays. This light is directed to the feeding path P side of the recording paper with a high efficiency. Also, such a halogen lamp 12*b* discharges also a large amount of heat. This heat is directed to the sheet paper passage P side of the recording paper with a high efficiency by the reflecting concave surface mirror member 12*a*. Thus, when the recording paper passing the liquid-state catalyst coating unit 10 passes above the heating and near IR irradiation unit 12 along the sheet paper passage P, the recording agent retaining surface of the recording paper receives a sufficient irradiation of near infrared rays from the thermal emission and near IR irradiation source 12*b* and, at the same time, is heated, whereby the recording agent on the recording paper is erased, and it becomes possible to reuse the recording paper. The decomposition of the near IR erasable dye is promoted in a high temperature atmosphere, and therefore although the erasing processing temperature should be set high for an enhancement of efficiency of the erasing processing, that temperature must be set so as to prevent the change of color by the burning of the recording paper. Also, the erasing processing temperature should be set in relation to the feeding speed of the recording paper. By raising the erasing processing temperature, it is possible to increase the feeding speed of the recording paper. Accordingly, in the above-mentioned erasing method, it is also possible to always detect the erasing processing temperature to make the feeding speed of the recording paper variable. In general, the erasing processing temperature can be set within a range of from about 130° C. to about 420° C. Note that, in the present embodiment, as the thermal emission and near IR irradiation source, a halogen lamp 12*b* is used, but it is also possible to use another lamp, for example, a metal halide lamp.

It should be noted here that the erasing method according to the first aspect of the present invention is directed to the erasing of the recording agent of a recording medium recorded by a non-catalyst-containing recording agent composed of a near IR erasable dye. Accordingly, a catalyst is not contained in the recording agent on the recording medium, and therefore the concentration of that recording agent is stably maintained for a long period, and therefore the persistency of that recording medium is enhanced. On the other hand, when such a recording paper is reused, a liquid-state catalyst is coated on that recording agent at first, and subsequently that recording paper is heated and, at the same time, receives the irradiation of the near infrared rays and simultaneously heated, and therefore the erasing processing of the recording agent can be quickly and in addition almost completely carried out.

In the above erasing method, the catalyst concentration of the liquid-state catalyst becomes one of important parameters. This is because, if the catalyst concentration of the liquid-state catalyst is too low, a good erasing processing cannot be achieved, while if the catalyst concentration of the liquid-state catalyst is too high, a large amount of catalyst remains in the reused recording paper, and therefore when the recording is carried out on that reused recording paper by the recording agent composed of the near IR erasable dye, the recording density thereof is lowered, and the persistency of the recording paper is deteriorated.

Therefore, an experiment was carried out concerning the erasing processing state and persistency of the reused recording paper for each when the erasing processing is carried out by the liquid-state catalyst having four types of catalyst concentrations, that is, catalyst concentrations of 0.3 percent, 0.5 percent, 5.0 percent, and 6.0 percent. The experimental conditions were as follows:

(a) A recording was carried out with an optical density (OD) of 0.8 by a non-catalyst-containing recording agent composed of a near IR erasable dye on an A4 size cut paper.

(b) A liquid-state catalyst was coated on such an A4 size cut paper using the liquid-state catalyst coating means 10 as shown in FIG. 1. At this time, the feeding rate of the A4 size cut paper was about 20 mm/sec, and the coating amount of the liquid-state catalyst was about 1.5 g.

(c) Subsequently, the A4 size cut paper was made to pass above a halogen lamp of 400 watts at a speed of about 20 mm/sec with a distance of only about 3 cm therefrom.

(d) Subsequently, the recording was carried out on an A4 size cut paper passing the erasing processing (that is a reused recording paper) with an optical density (OD) of 0.8 by a non-catalyst-containing recording agent composed of a near IR erasable dye, and thereafter was left to stand under a fluorescent light of 100 lux for 50 hours.

The results of the experiment were as indicated in the following table.

TABLE 1

| Catalyst concentration % | 0.3 | 0.5 | 5.0 | 6.0 |
|---|---|---|---|---|
| Optical density after erasing processing (OD) | 0.4 | 0.2 | 0.2 | 0.1 |
| Optical density after being left to stand for 50 hr (OD) | 0.8 | 0.7 | 0.7 | 0.5 |

In general, so as to make it possible to sufficiently view and confirm the recorded letters, etc., 0.6 (OD) is necessary as the recording density, and so as to erase the same to an extent where they cannot be seen and confirmed by the naked eye, an erasing processing of 0.2 (OD) or less is necessary. As apparent from the above table, it is seen that preferably the catalyst concentration of the liquid-state catalyst is maintained within a range of from 0.5 through 5.0 percent.

Figure 2:
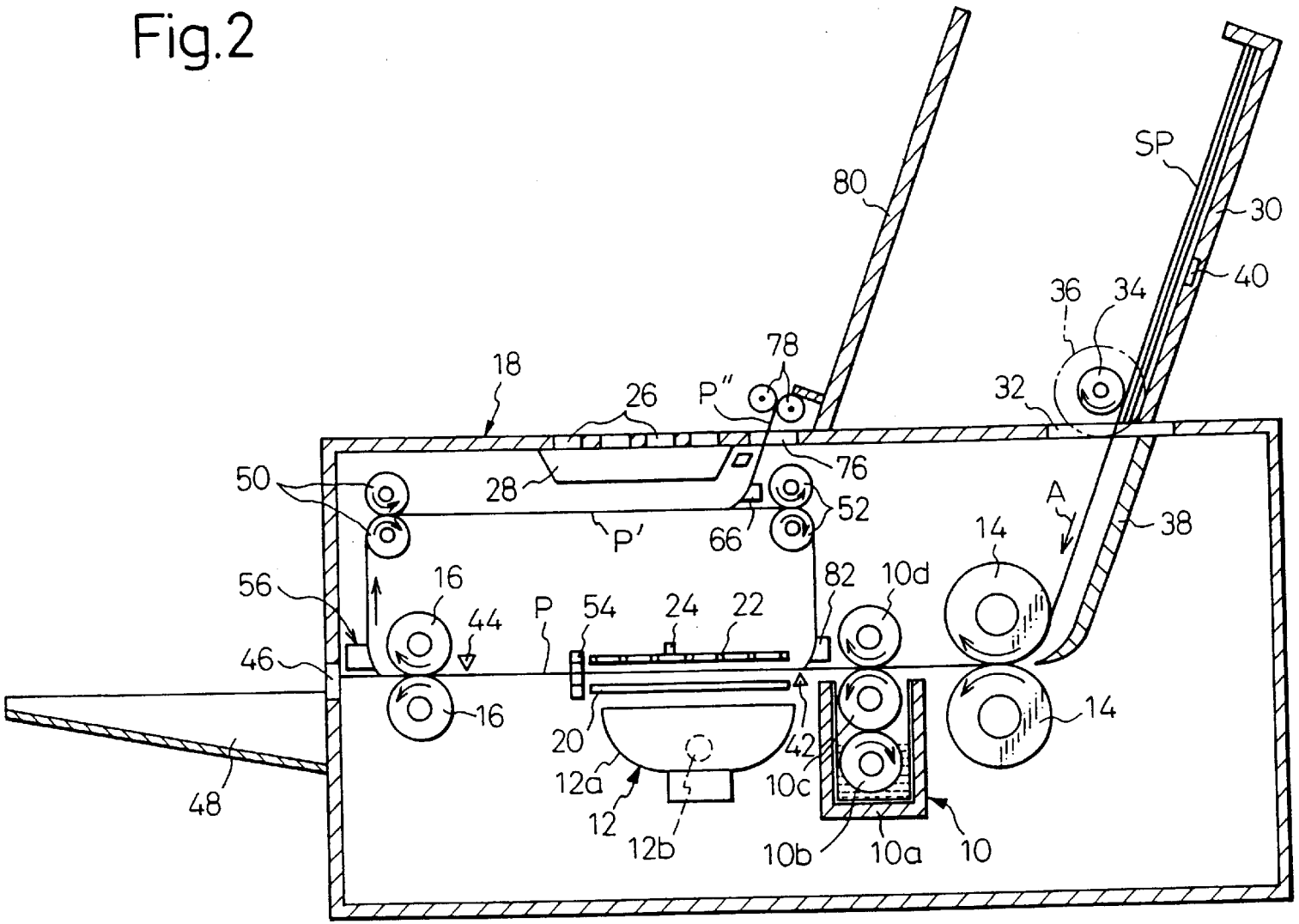
FIG. 2 is a schematic view showing a preferred embodiment of the erasing apparatus constituted according to the first aspect of the present invention.

Referring to FIG. 2, a preferred embodiment of the erasing apparatus according to the present invention is shown. The above-mentioned erasing method is worked even by this erasing apparatus. Note that, in FIG. 2, constituent elements similar to the constituent elements shown in FIG. 1 are given the same reference symbols, and reference symbol P and arrow A denote the sheet paper passage of the recording medium such as the recording paper and movement direction of the recording paper, respectively.

As shown in FIG. 2, the liquid-state catalyst coating means 10, the heating and near IR irradiation unit 12, the pair of paper feed rollers 14 and 14, and the pair of sheet paper feeding rollers 16 and 16 are accommodated together inside the housing 18 of the erasing apparatus. The liquid-state catalyst coating unit 10 has a structure similar to that of the case of FIG. 1, and a liquid-state catalyst (catalyst concentration of within a range of from about 0.5 through about 5 percent by weight) using an alcohol, acetone, water, or the like as the solvent is retained in that retaining tank 10*a*, a roller assembly comprising a lower roller 10*b*, a middle roller 10*c* and an upper roller 10*d* is arranged in the retaining tank 10*a*, and the respective rollers have the same function as those of FIG. 1. Also the heating and near IR irradiation means 12 is similarly constituted by the reflecting concave surface mirror member 12*a* and the thermal emission and near IR irradiation source 12*b* such as a halogen lamp arranged at the focus of the reflecting concave surface mirror member 12*a* in the same way as that of the case of FIG. 2.

In the embodiment shown in FIG. 2, a heat resistant glass plate 20 is arranged as a light transmitting plate on the upstream side of the heating and near IR irradiation unit 12. This heat resistant glass plate 20 partially defines the sheet paper passage P of the recording paper by cooperating with the metal plate 22 arranged above this. Namely, the heat resistant glass plate 20 and the metal plate 22 act as a guide plate with respect to the recording paper. When the recording paper passes above the heat resistant glass plate 20, it receives the irradiation of near infrared rays from the heating and near IR irradiation unit 12 through the heat resistant glass plate 20. A large number of perforations are formed in the metal plate 22, and due to these large number of perforations, heat is prevented from being confined between the heat resistant glass plate 20 and the metal plate 22. As shown in FIG. 2, a temperature sensor 24 such as for example a thermistor is incorporated in the metal plate 22. This temperature sensor 24 detects the temperature of the metal plate 22 and monitors the temperature inside the sheet paper passage defined by the heat resistant glass plate 20 and the metal plate 22. Note that, a large number of perforations 26 are formed in a part of the upper wall of the housing 18, and a cooling fan 28 is provided inside the top wall part, whereby the temperature rise inside the housing 18 is suppressed.

In the present embodiment, a paper feed hopper 30 for accommodating a stack SP of the recording paper which should be reused is provided in the erasing apparatus. This paper feed hopper 30 is arranged at a position of the sheet paper introduction opening 32 formed in the top wall portion of the housing 18. Note that, the recording surfaces of the recording paper of the stack SP are made to face the bottom surface side of the paper feed hopper. The paper feed hopper 30 is provided with a feed out roller 34, which feed out roller 34 is connected via an electromagnetic clutch 36 to the rotation drive source. The feed out roller 34 receives the rotation drive force from the rotation drive source only at the operation time of the electromagnetic clutch 36 and is thus driven to rotate, but the feed out roller 34 enters into a free rotation state at the time of releasing the operation of electromagnetic clutch 36. When the electromagnetic clutch 36 is operated, the feed out roller 34 is rotated, whereby only one sheet of the recording paper is fed out from the stack SP, and this recording paper is guided to the paper feed rollers 14 and 14 by the guide plate 38 provided inside the housing 18. A sheet paper detector, for example, a contact switch 40, is incorporated in the paper feed hopper 30, and the presence or absence of the paper inside the paper feed hopper 30 is detected by this sheet paper detector 40.

The recording paper guided to the paper feed rollers 14 and 14 passes between the middle roller 10*c* and the upper roller 10*d* of the liquid-state catalyst coating means 10 and then is sent to the heating and near IR irradiation means 12. A sheet paper detector, for example, a contact switch 42, is provided on the sheet paper introduction side of the heating and near IR irradiation unit 12, which sheet paper detector 42 detects the passing of the recording paper going from the liquid-state catalyst coating unit 10 toward the heating and near IR irradiation unit 12. Moreover, a sheet paper detector, for example, a contact switch 44, is provided also on the sheet paper introduction side of the sheet paper feeding rollers 16 and 16. This sheet paper detector 44 detects the passing of the recording paper coming after passing the liquid-state catalyst coating unit 10 and the heating and near IR irradiation unit 12. A sheet paper eject opening 46 aligned with the sheet paper feeding rollers 16 and 16 is formed in the side wall of the housing 18, and the recording paper is ejected to the outside of the housing 18 by the sheet paper feeding rollers 16 and 16 through this sheet paper eject opening 46 and is stacked on the ejected paper stocker 48 provided outside of that side wall. Note that, as will be mentioned later, the recording paper ejected from the sheet paper eject opening 46 is not suitable for reuse.

As shown in FIG. 2, in the present embodiment, a sheet paper circulation path P' from the sheet paper eject side of the sheet paper feeding rollers 16 and 16 up to the sheet paper introduction side of the heating and near IR irradiation means 12 is provided in the housing 18. This sheet paper circulation path P' is defined by appropriately arranging a guide plate similar to the case of the sheet paper passage P. A pair of sheet paper feeding rollers are arranged at an appropriate position of the sheet paper circulation path P'. In the present embodiment, two pairs of sheet paper feeding rollers 50 and 50, and 52 and 52 are provided. These sheet paper feeding rollers are driven to rotate in the directions indicated by the arrows shown in the figure, respectively, at the operation time of the erasing apparatus. On the other hand, an optical erasing sensor 54 is arranged on the sheet paper eject side of the heating and near IR irradiation unit 12, and this optical erasing sensor 54 detects whether or not the recording agent is erased well from the recording paper passing the heating and near IR irradiation unit 12. For example, the optical erasing sensor 54 comprises a large number of CCD's aligned on one line and detects the reflection optical density (OD) on the recording paper. By comparing this reflection optical density with a predetermined threshold value, it is decided whether or not the recording agent is erased well from the recording paper. When it is decided that the recording agent is not erased from the recording paper, the recording paper is sent from the sheet paper passage P to the sheet paper circulation path P' and made to pass the heating and near IR irradiation unit 12 again.

Figure 3:
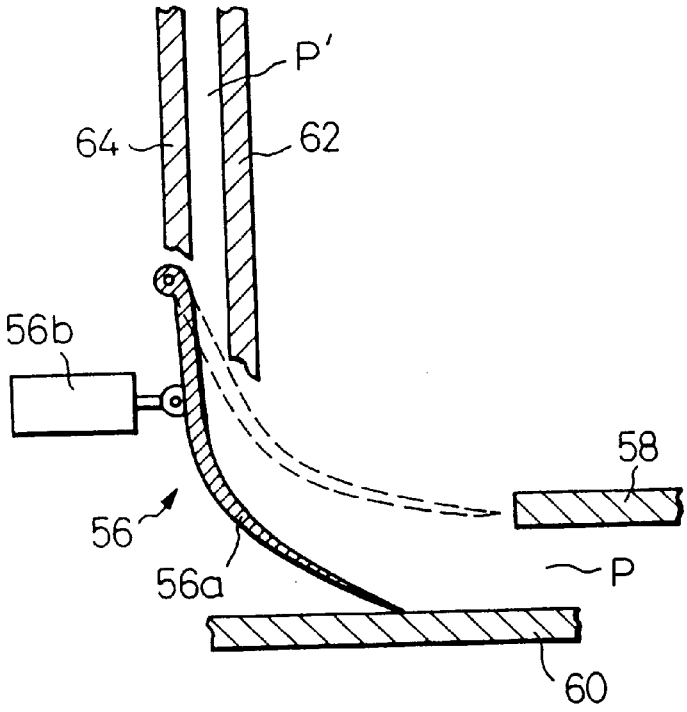
FIG. 3 is a cross-sectional view showing a sheet paper switching unit of the erasing apparatus of FIG. 2 in detail.

A sheet paper switching unit 56 is provided on the sheet paper eject side of the sheet paper feeding rollers 16 and 16 so as to change the direction of the recording paper from the sheet paper passage P to the sheet paper circulation path P'. Details of this sheet paper switching unit 56 are shown in FIG. 3. In the same figure, reference numerals 58 and 60 denote guide plates defining the sheet paper passage P, respectively, and reference numerals 62 and 64 denote the guide plates defining the sheet paper circulation path P', respectively. The sheet paper switching unit 56 includes a curved flap 56*a* which can be freely pivoted and comes to form an extended portion of the guide plate 64 of the sheet paper circulation path P' and an electromagnetic Solenoid 56*b* pivoting this curved flap 56*a* between a solid line position and broken line position of FIG. 3. A tip end of the operation rod of the electromagnetic solenoid 56*b* is pivotally secured to the curved flap 56*a,* and at the non-operation time of the electromagnetic solenoid 56*b,* that is, in an "OFF" state at which electrical bias is not effected, the operation rod is brought into the pulling state. By this, the curved flap 56*a* is placed at the position indicated by a solid line, and at this time, the recording paper is guided from the sheet paper passage P to the sheet paper circulation path P'. On the other hand, at the operation time of the electromagnetic solenoid 56*b,* that is, in an "ON" state in which electrical bias is effected, the operation rod of the electromagnetic solenoid 56*b* is brought to the extended state, whereby the curved flap 56*a* is pivoted from the solid line position to the broken line position, and at this time the recording paper is ejected onto the ejected paper stocker 48 through the sheet paper opening 46. Note that, at the normal operation time of the erasing apparatus, the curved flap 56*a* is made to stay at the solid line position of FIG. 3.

Figure 4:
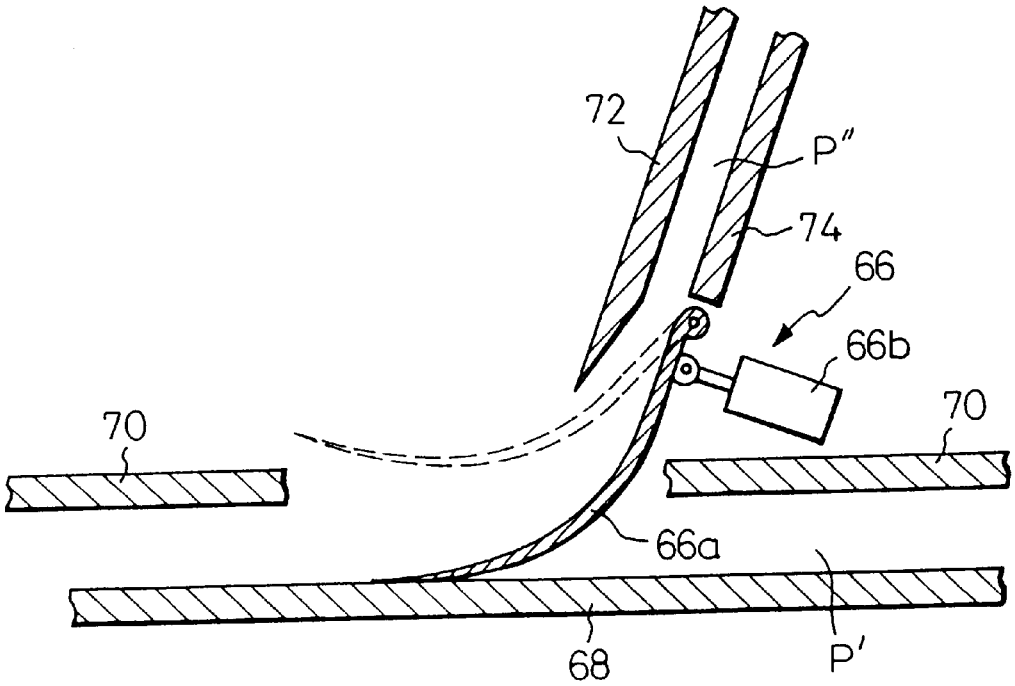
FIG. 4 is a cross-sectional view showing another sheet paper switching unit of the erasing apparatus of FIG. 2 in detail.

Also, a similar sheet paper switching unit 66 is provided also on the sheet paper introduction side of the sheet paper feeding roller 52. Details of this sheet paper switching unit 66 are shown in FIG. 4. In the same figure, reference numerals 68 and 70 denote guide plates defining the sheet circulation path P', and reference numerals 72 and 74 denote guide plates defining the sheet paper eject path P", respectively. The sheet paper switching unit 66 includes a pivotable curved flap 66*a* which comes to form an extended portion of the guide plate 74 of the sheet paper circulation path P', and an electromagnetic solenoid 66*b* which pivots this curved flap 66*a* between the solid line position and broken line position of FIG. 4. The tip end of the operation rod of the electromagnetic solenoid 66*b* is pivotally secured to the curved flap 66*a,* and at the ton-operation time of the electromagnetic solenoid 66*b,* that is, in an "OFF" state in which electrical bias is not effected, the operation rod is brought into the pull-in state, whereby the curved flap 66*a* is placed at the solid line position, and at this time, the recording paper is guided from the sheet paper circulation path P' to the sheet paper eject path P". As shown in FIG. 2, the sheet paper eject path P" is extended toward the sheet paper eject opening 76 formed on the top portion wall of the housing, and a pair of paper eject rollers 78 and 78 and the ejected paper stocker 80 are provided on the outside of the sheet paper eject opening 76. As will be mentioned later, the recording paper for which the erasing processing was carried out well is guided from the sheet paper circulation path P' to the sheet paper eject path P", and then ejected onto the ejected paper stocker 80 by the paper eject rollers 78 and 78. On the other hand, at the operation time of the electromagnetic solenoid 66*b,* that is, in an "ON" state in which the electrical bias is carried out, the operation rod of the electromagnetic solenoid 66*b*is brought into the extended state, whereby the curved flap 66*a* is pivoted from the solid line position to the broken line position, and at this time, the recording paper is further advanced in the sheet paper circulation path P' toward the sheet paper introduction side of the heating and near IR irradiation unit 12. Note that, at the time of normal operation of the erasing apparatus, the curved flap 66*a* is stopped at the solid line position of FIG. 4.

Figure 5:
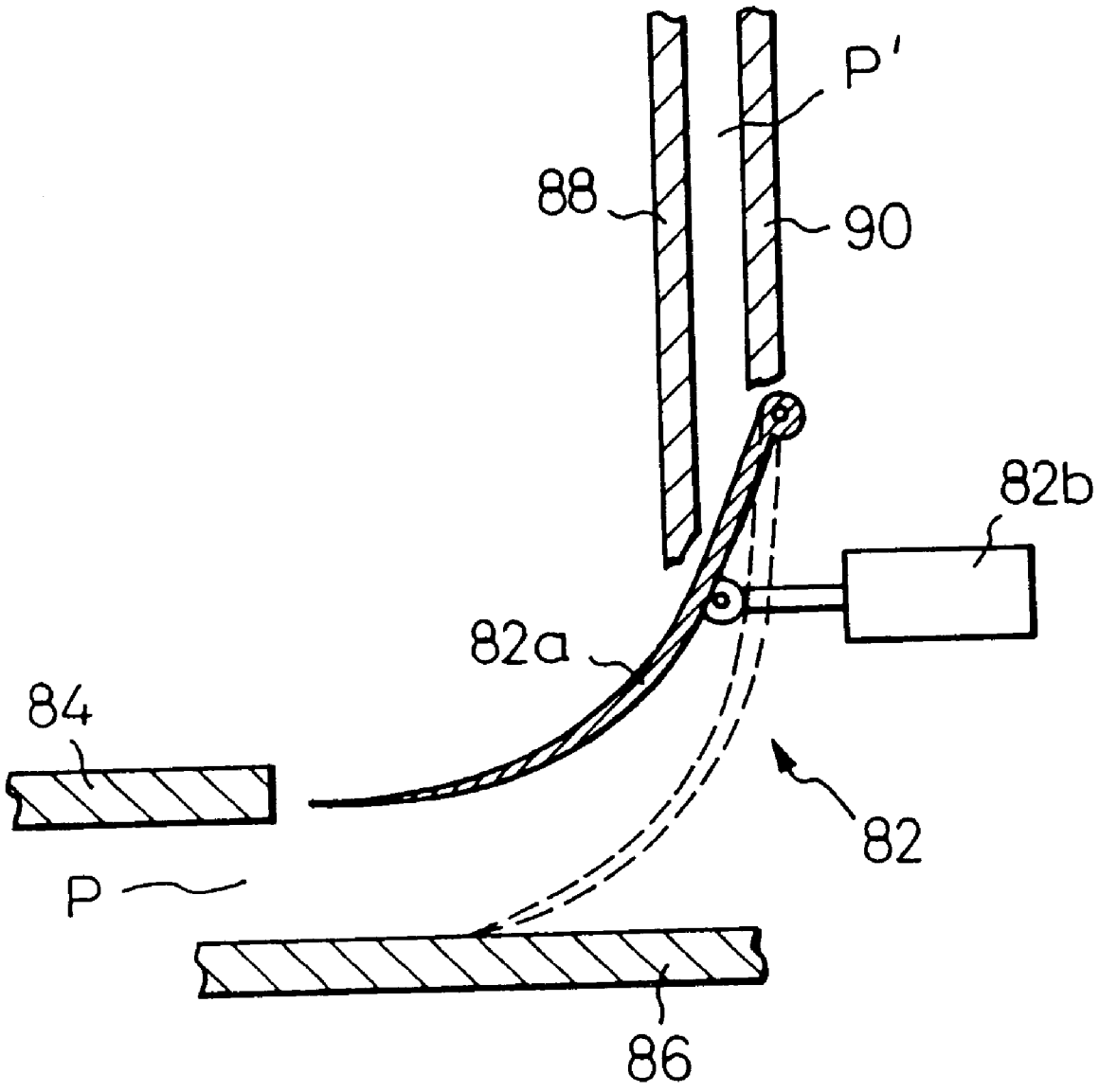
FIG. 5 is a cross-sectional view showing still another sheet paper switching unit of the erasing apparatus of FIG. 2 in detail.

As shown in FIG. 2, a similar sheet paper switching unit 82 is provided also on the sheet paper introduction side of the heating and near IR irradiation unit 12. Details of this sheet paper switching unit 82 are shown in FIG. 5. In the same figure, reference numerals 84 and 86 denote guide plates defining the sheet circulation path P'. The sheet paper switching unit 82 includes a pivotable curved flap 82*a* which comes to form an extended portion of the guide plate 90 of the sheet paper circulation path P' and an electromagnetic solenoid 82*b* which pivots this curved flap 82*a* between the solid line position and broken line position of FIG. 5. The tip end of the operation rod of the electromagnetic solenoid 82*b* is pivotally secured to the curved flap 82*a,* and at the non-operation time of the electromagnetic solenoid 82*b,* that is, in an "OFF" state in which electrical bias is not effected, the operation rod is brought into the extended state, whereby the curved flap 82*a* is placed at the solid line position, and at this time, the sheet paper circulation path P' is closed by the curved flap 82*a,* but the sheet paper passage P is brought to the released state. Namely, the recording paper can pass through the sheet paper passage P from the liquid-state catalyst coating unit 10 toward the heating and near IR irradiation unit 12 without obstacle by the curved flap 82*a*. On the other hand, at the operation time of electromagnetic solenoid 82*b,* that is, in an "ON" state in which the electrical bias is carried out, the operation rod of the electromagnetic solenoid 82*b* is brought into the pull-in state, whereby the curved flap 82*a* is pivoted from the solid line position to the broken line position, and at this time, the sheet paper circulation path P' is communicated with the sheet paper passage P, and thus the recording paper is guided from the sheet paper circulation path P' to the sheet paper passage P. In summary, the recording paper coming after passing the sheet paper circulation path P' is fed again on the heating and near IR irradiation unit 12. Note that, at the time of normal Operation of the erasing apparatus, the curved flap 66*a* is stopped at the solid line position of FIG. 5.

In the present embodiment, in the housing 18, a marker 92 is provided close to the sheet paper Eject opening portion 76. This marker 92 is used according to need so as to impart an appropriate mark to a margin region of the recording paper ejected onto the ejected paper stocker 80. As mentioned above, the recording paper regenerated by the erasing apparatus, that is, the reused sheet paper, includes the catalyst, and therefore where the recording is carried out again there by the recording agent composed of the near IR erasable dye, the concentration of that recording agent can be lowered under the presence of the catalyst. Accordingly, it is not preferred if this reused recording paper is used as a document for long term storage. By using such a marker 92, it becomes possible to discriminate whether the recording paper is a reused paper or a new one.

Figure 6:
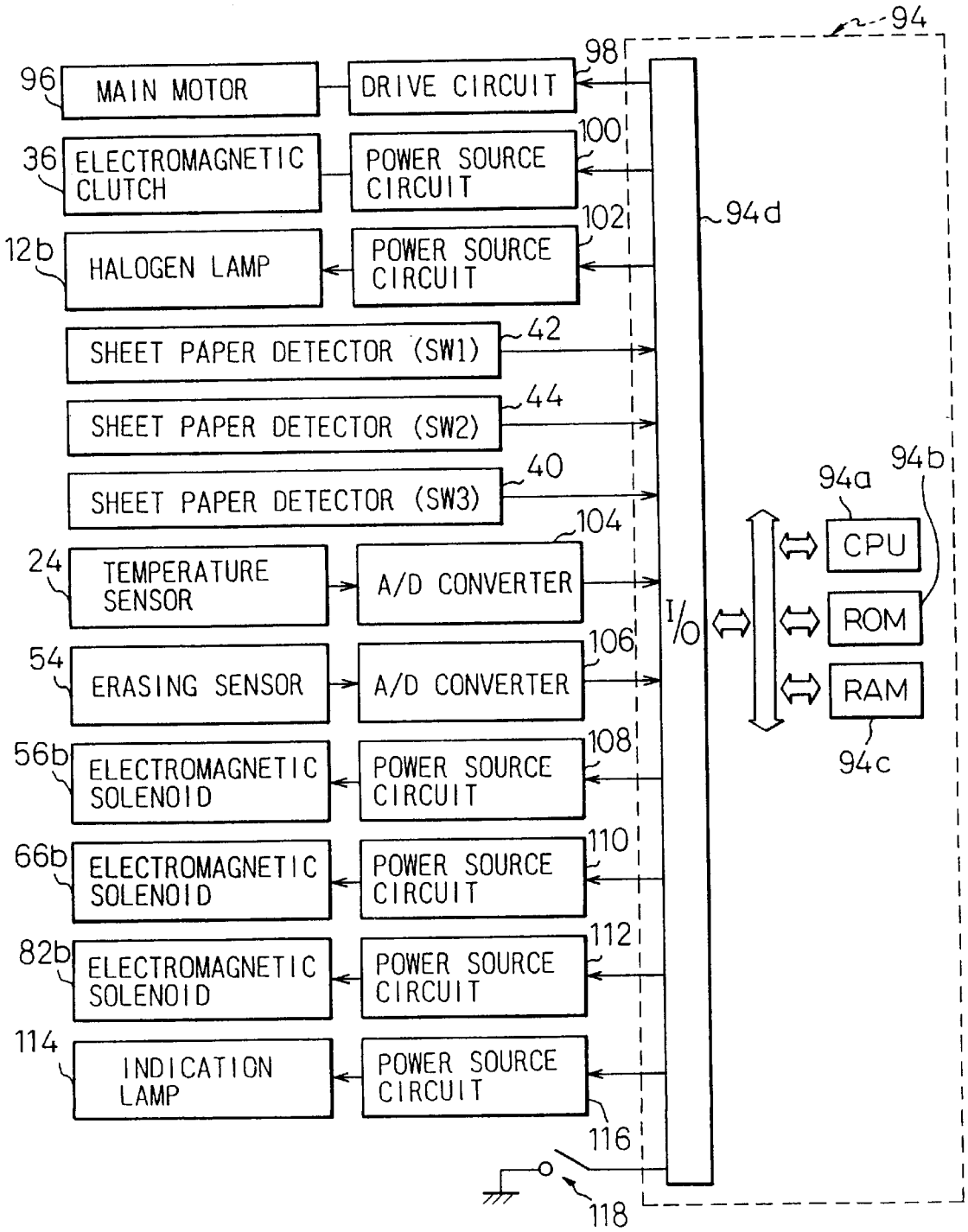
FIG. 6 is a block diagram of the control of the erasing apparatus of FIG. 2.

Referring to FIG. 6, there is shown a block diagram of the control of the erasing apparatus shown in FIG. 2. A control circuit 94 constituted by a microcomputer is shown in this block diagram. AS apparent from FIG. 6, the microcomputer includes a central processing unit (CPU) 94*a,* an operation program, a read only memory (ROM) 94*b* storing constants etc., a random access memory (RAM) 94*c* storing temporary data etc., and an input/output (I/O) interface 94*d*.

In FIG. 6, reference numeral 96 denotes a main motor of the erasing apparatus, for example, a pulse motor, which main motor 96 is used as a drive source of the roller assembly of the liquid-state catalyst coating means 10, the paper feed roller 14, the sheet paper feeding roller 16, the feed out roller 34, the sheet paper feeding rollers 50 and 52, the paper eject roller 78, etc. The main motor 96 is driven by the drive pulse from the drive circuit 98, and the drive circuit 98 is controlled through the I/O 94*d* by the control circuit 94. An electromagnetic clutch 36 is actuated by a power source circuit 100, which power source circuit 100 is controlled by the control circuit 94 through the I/O 94*d*. The halogen lamp 12*b* is turned on or off by the power source circuit 102, which power source circuit 102 is controlled by the control circuit 94 through the I/O 94*d*. As mentioned above, in the present embodiment, the sheet paper detectors 42, 44 and 40 are constituted as contact switches, respectively, which contact switches are connected to the I/O 94*d* of the control circuit 94. When the contact switches are "OFF", the output signals thereof are at a low level "L", but when the contact switches are turned "ON", the output signals are changed from the low level "L" to the high level "H". The outputs of the temperature sensor 24 and the optical erasing sensor 54 are converted to digital signals by A/D converters 104 and 106, respectively, and fetched into the control circuit 94 through the I/O 94*d*. The electromagnetic solenoids 56*b*, 66*b* and 82*b* are operated by the power source circuits 108, 110 and 112, respectively, and the respective power source circuits are controlled by the control circuit 94 through the I/O 94*d*. The indication lamp 114 is used so as to indicate the situation to the user to prompt him to raise the voltage applied to the halogen lamp 12*b* as will be mentioned later. The indication lamp 114 is turned on by the power source circuit 116, which power source circuit 116 is controlled by the control circuit 94 through the I/O 94*d*. Note that, in FIG. 6, reference numeral 118 denotes a start switch. When this start switch 118 is turned "ON" after the turning "ON" of the power source switch (not illustrated), the operation of the erasing apparatus is started.

Figure 7:
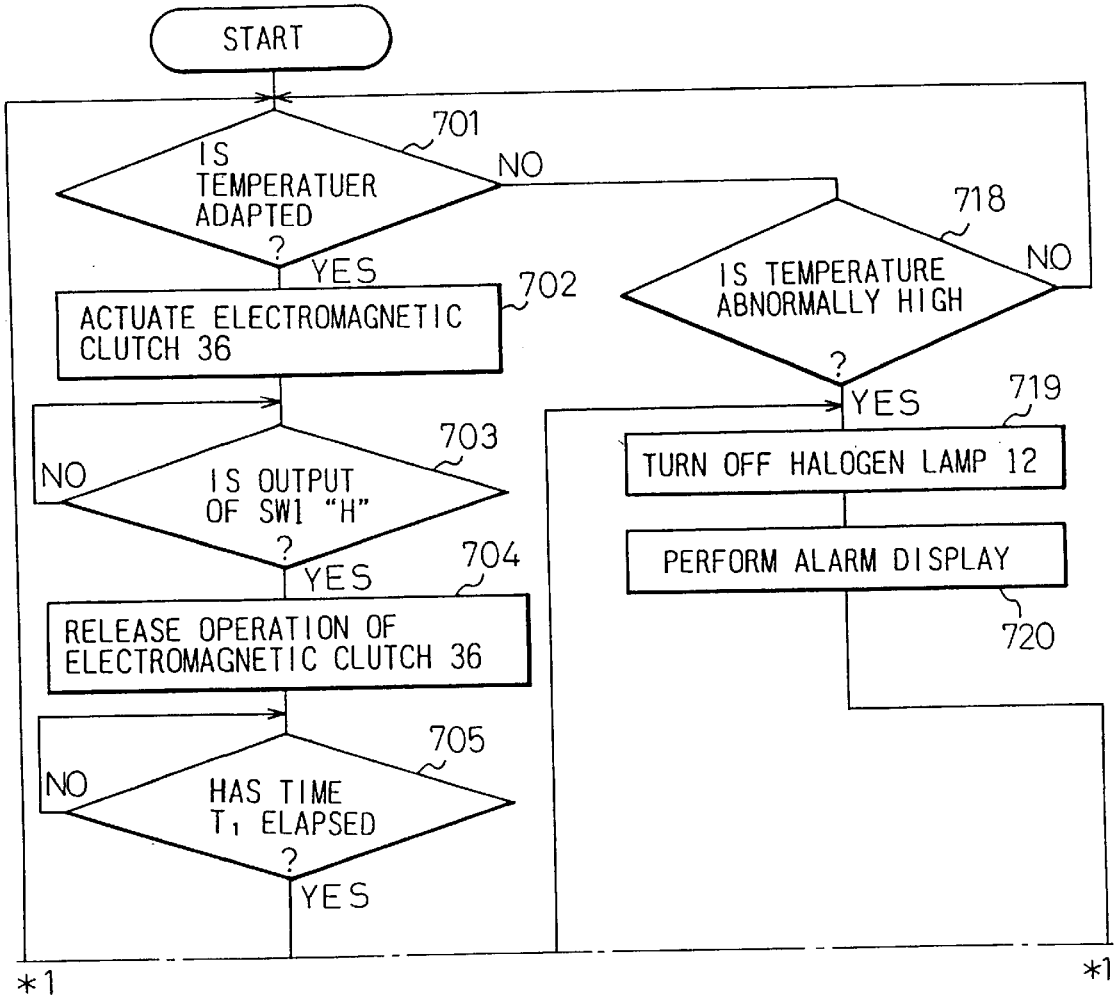
FIG. 7 is a flow chart showing a part of an operation routine explaining the operation of the erasing apparatus of FIG. 2.
Figure 8:
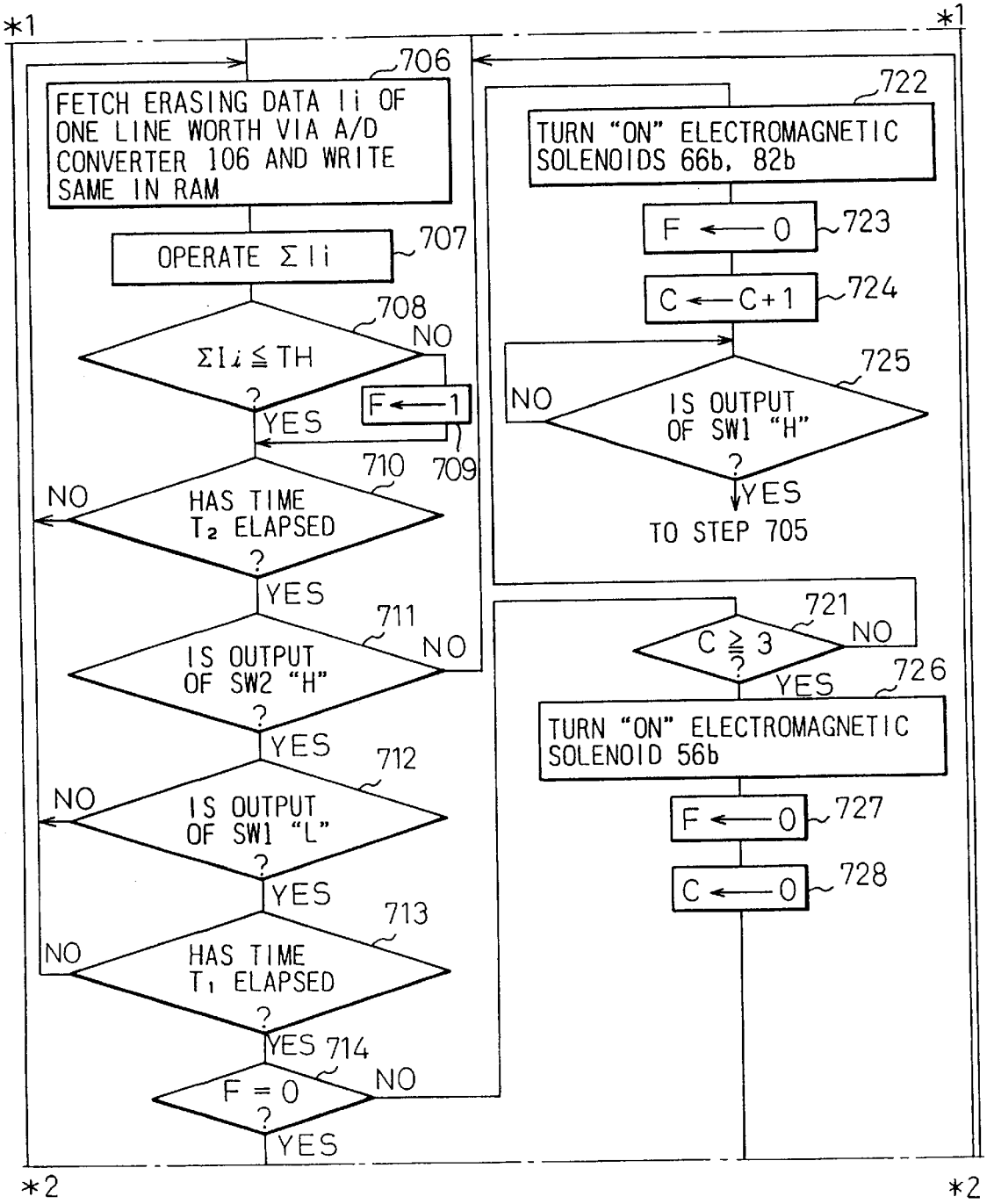
FIG. 8 is a flow chart showing a part of the operation routine explaining the operation of the erasing apparatus of FIG. 2.
Figure 9:
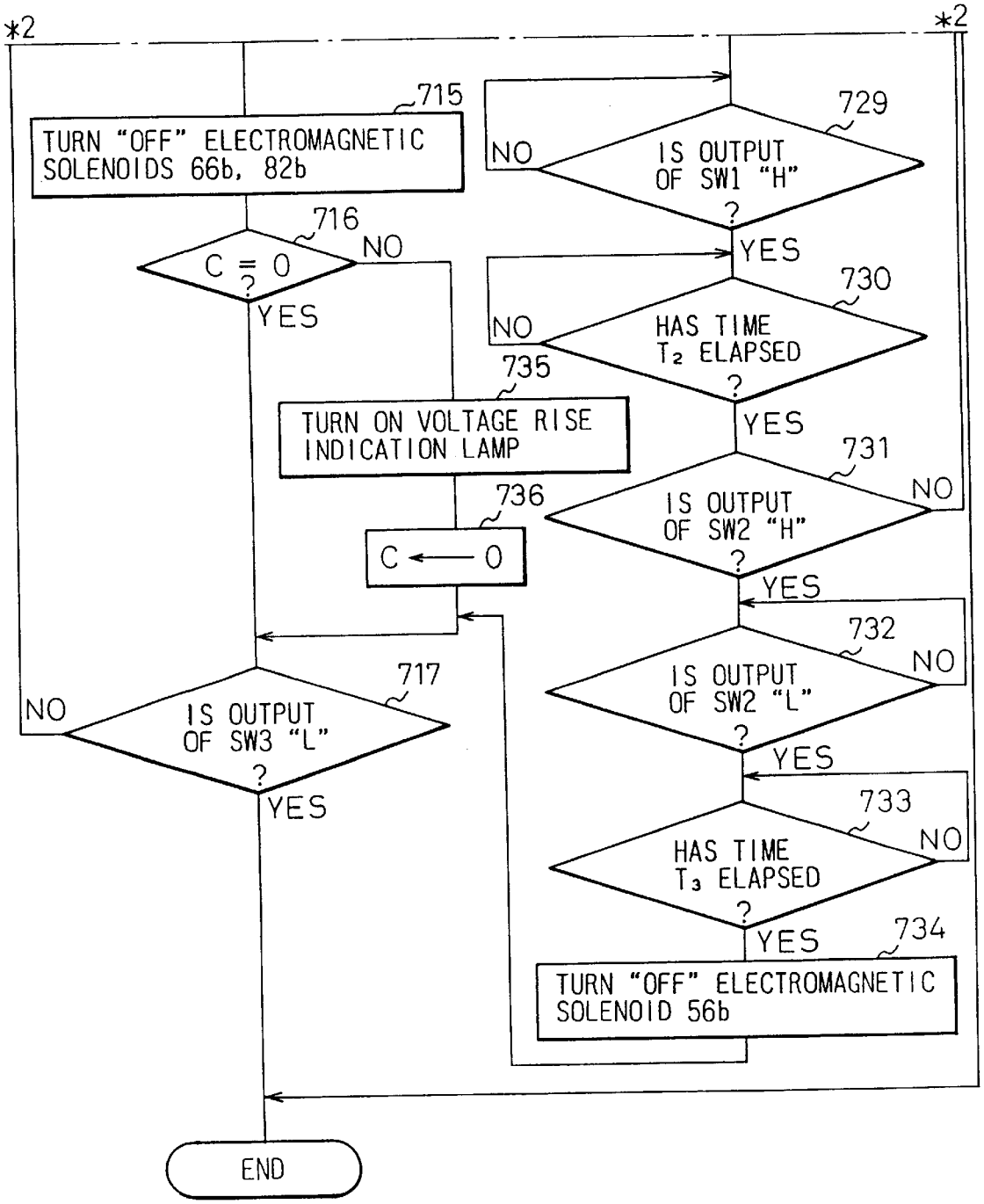
FIG. 9 is a flow chart showing a part of the operation routine explaining the operation of the erasing apparatus of FIG. 2.

An explanation will be made next of the operation of the above-mentioned erasing apparatus referring to the operation routines shown in FIG. 7 through FIG. 9. Note that, when the power source switch of the erasing apparatus is turned "ON", the main motor 96 is driven by the control circuit 94 and, at the same time, the halogen lamp 12*b* is turned on. By turning "ON" the start switch 118, the operation routines of FIG. 7 through FIG. 9 are executed.

At step 701, the detection data of the temperature sensor 24 is fetched through the A/D converter 104, and it is decided whether or not that detection temperature is a temperature suitable to the erasing processing. For example, when the detection temperature is within a range of from 130 through 200 degrees, it is decided that the temperature is proper, and the routine proceeds to step 702, at which the electromagnetic clutch 36 is actuated. As a result, the feed out roller 34 is driven, and only one sheet of the recording paper is fed out from the bundle SP in the paper feed hopper 30. This recording paper is made to pass the liquid-state catalyst coating means 10 guided by the paper feed rollers 14 and 14 by the guide plate 38 provided in the housing 18, whereby the liquid-state catalyst is coated on the recording surface of the recording paper. Subsequently, at step 703, the "ON"/"OFF" of the sheet paper detector (SW1) 42, that is, whether or not the output thereof is at the high level "H" or the low level "L", is decided. When the Output of the sheet paper detector (SW1) 42 becomes the high level "H", that is, when the tip end of the recording paper is detected by the sheet paper detector (SW1) 42, the routine proceeds to step 704, at which the operation of the electromagnetic clutch 36 is released. The recording paper receives the irradiation of the near infrared rays by the heating and near IR irradiation means 12 and, at the same time, heated. At step 705, it is decided whether or not the time $T_1$ is elapsed. The time $T_1$ is defined as a time required from when the tip end of the recording sheet is detected by the sheet piper detector (SW1) 42 to when it reaches the position at which the optical erasing sensor 54 is disposed. Note that, the time $T_1$ is preliminarily stored in the ROM 94*b* as a constant.

When the time $T_1$ has elapsed, the routine proceeds to step 706, at which one line's worth of erasing data $I_i$ is fetched from the optical erasing sensor 54 via the A/D converter 106, and subsequently, at step 707, the operation of $\Sigma I_i$ is carried out. At step 708, it is decided whether or not the result of the operation of $\Sigma I_i$ is smaller than the predetermined threshold value TH. When $\Sigma I_i \leqq TH$, it means that the erasing of the recording agent of the recording paper, correctly the recording agent at a portion corresponding to the above-mentioned one line, is carried out well, and when $\Sigma I_i \geqq TH$, it means that the erasing of the recording agent was incomplete. In the latter case, the routine proceeds to step 709, at which the flag F is rewritten from "0" to "1", and subsequently, the routine proceeds to step 710. If in the former case, that is, if the erasing is carried out well, the routine proceeds from step 708 to step 710.

At step 710, it is decided whether or not the time $T_2$ has elapsed. The time $T_2$ is defined as a time required from when the tip end of the recording sleet is detected by the sheet paper detector (SW1) 42 to when it reaches the position at which a paper sheet detector (SW2) 44 is disposed. Until the time $T_2$ has elapsed, the routine returns to step 706, at which it is monitored whether or not the erasing processing is being carried out well. When the time $T_2$ has elapsed, the routine proceeds from step 710 to step 711, at which the "ON"/"OFF" state of the sheet paper detector (SW2) 44, that is, whether or not the output thereof is at the high level "H" or the low level "L", is decided. When the output of the sheet paper detector (SW2) 44 becomes the high level "H", that is, when the tip end of the recording paper is detected by the sheet paper detector (SW2) 44, this means that the recording paper safely passes the heating and near IR irradiation means 12 without an occurrence of paper jamming in the heating and near IR irradiation means 12. Note that, the time $T_2$ is preliminarily stored in the ROM 94*b* as a constant in the same way as the time $T_1$.

Subsequently, at step 712, the "ON"/"OFF" state of the sheet paper detector (SW1) 42, that is, whether or not the output thereof is at the low level "L" or the high level "H", is decided. When the sheet paper detector (SW1) 42 is "ON", this means that the rear end of the recording paper has not yet passed the sheet paper detector (SW1) 42. Until the rear end of the recording paper passes the sheet paper detector (SW1) 42, the routine returns from step 712 to step 706, at which it is subsequently monitored whether or not the erasing processing is being carried out well.

When the sheet paper detector (SW1) 42 becomes "OFF" at step 712, that is, when the rear end of the recording paper passes the sheet paper detector (SW1) 42, the routine proceeds to step 713, at which it is decided whether or not the time $T_1$ has elapsed. The time $T_1$ is defined as a time required from when the rear end of the recording paper passes the sheet paper detector (SW1) 42 to when it ends to pass the position at which the optical erasing sensor 54 is disposed, and this time is the same as the time required from when the tip end of the recording sheet is detected by the sheet paper detector (SW1) 42 to when it reaches the position at which the optical erasing sensor 54 is disposed. Until the time $T_1$ is elapsed, the routine returns from step 713 to step 706, at which it is subsequently monitored whether or not the erasing processing is being carried out well.

When the time $T_1$ has elapsed at step 713, that is, when the rear end of the recording paper passes the position at which the optical erasing sensor 54 is disposed, the routine proceeds to step 714, at which it is decided whether the flag F is "0" or "1". If F=0, that is where the erasing processing of the recording agent of the recording paper is carried out well, the routine proceeds to step 715, at which the electromagnetic solenoids 66*b* and 82*b* are brought to the "OFF" state. Note that, in the initial state, all electromagnetic solenoids 56*b*, 66*b* and 82*b* have been brought to the "OFF" state. Subsequently, at step 716, it is decided whether or not the counter C is "0", and if C=0, the routine proceeds to step 717. Note that, as obvious from the disclosure mentioned later, unless the flag F is brought to "1" at step 709, the counter C is maintained in an initial state as it is. At step 717, "OFF"/"ON" of the sheet paper detector (SW3) 40, that is, whether or not the output thereof is at the low level "L" or the high level "H", is decided. When the output of the sheet paper detector (SW3) 40 is at the high level "H", that is, when the recording paper remains in the paper feed hopper 30, the routine returns to step 701, and when the output of the sheet paper sensor 40 is at the low level "L", that is, when the recording paper does not remain in the paper feed hopper 30, the operation routine is ended.

Note that, as mentioned above, in the initial state, all of the electromagnetic solenoids 56*b*, 66*n*, and 82*b* have been brought to the "OFF" state, and therefore the recording paper passing the heating and near IR irradiation means 12 is sent from the sheet paper passage P to the sheet paper circulation path P' by the sheet paper switching unit 56, and subsequently sent from the sheet paper circulation path P' to the sheet paper eject path P" by the sheet paper switching unit 66. At this time, an appropriate mark is given to the margin region of the recording paper by the marker 92. Subsequently, the recording paper is ejected onto the ejected paper stacker 80 by the paper eject roller 78. Note that, the recording paper ejected onto the ejected paper stacker 80 is one which has been subjected to good erasing processing, and therefore that recording paper becomes able to be reused.

Returning to step 701, when the detection temperature of the temperature sensor 24 is out of the range of from 130° C. through 200° C., the routine proceeds to step 718, at which it is decided whether or not the temperature is 200° C. or more. If it is 200° C. or more, there may be a chance of change of color of the recording paper, and therefore the routine proceeds to step 719, at which the halogen lamp 12*b* is turned "OFF", and subsequently an appropriate alarm for example an alarm lamp (not illustrated) is turned on at step 720, to warn the user. Note that, even at the initial operation, that is, even at a time immediately after the turning on of the halogen lamp 12*b* and when the temperature is 130° C. or less, the routine proceeds from step 701 to step 718. At this time, the routine returns again to step 701, and the erasing apparatus enters the stand-by state until the detection temperature of the temperature sensor 24 becomes 130° C. or more.

When the tip end of the recording paper is not detected by the sheet paper detector (SW2) 44 irrespective of the fact that the time $T_2$ has elapsed at step 711, it is judged that the recording paper has become clogged in the heating and near IR irradiation means 12, and at this time, the routine proceeds to step 719, at which the halogen lamp 12*b* is turned "OFF", then a warning is sent to the user by an appropriate alarm means.

When F=1 at step 714, this means that the erasing processing of the recording agent of the recording paper is not carried out well, and at this time, the routine proceeds from step 714 to step 721, at which it is decided whether or not the counted value of the counter C is 3 or more. In the initial state, C=0, and therefore the routine proceeds to step 722, at which the electromagnetic solenoids 66*b* and 82*b* of the sheet paper switching unit 66 are operated, whereby the curved flaps 66*a* and 82*a* are pivoted from the solid line position to the broken line position (FIG. 4 and FIG. 5). Thus, the recording paper sent from the sheet paper passage P to the sheet paper circulation path P' is not sent to the sheet paper eject path P" and goes toward the heating and near IR irradiation unit 12 again. At step 723, the flag F is returned from "1" to "0", and subsequently, at step 724, the value of the counter C is counted up only by "1". At step 725, the "ON"/"OFF" state of the sheet paper detector (SW1) 42, that is, whether or not the output thereof is at the high level "H" or the low level "L", is decided. In summary, when the tip end of the recording paper directed again from the sheet paper circulation path P' to the heating and near IR irradiation unit 12 is detected by the sheet paper detector (SW1) 42, the routine proceeds to step 705, at which the erasing processing is repeated again and, at the same time, the evaluation of that erasing processing is carried out. When the erasing processing is not carried out well, F is made equal to 1 at step 709, and therefore the routine proceeds from step 714 to step 721.

If the same recording paper is repeatedly sent to the heating and near IR irradiation unit 12 three times to apply the erasing processing to the same and despite that the erasing processing fails, it is judged that the recording was carried out on the recording paper by a recording agent other than the erasable recording agent (for example, pencil, ball pen, etc.) or it is contaminated by another coloring agent, and therefore such a recording paper is ejected to the outside of the erasing apparatus, that is, on to the ejected paper stacker 48 as paper which can not be reused. Explaining this in detail, when C is made equal to 3 at step 721, the routine proceeds from step 721 to step 726, the electromagnetic solenoid 56*b* of the sheet paper switching unit 56 is turned "ON", and the curved flap 56*a* is moved from the solid line position to the broken line position. Subsequently, at step 727, the flag F is returned from "1" to "0", and subsequently, at step 728, the counter C is reset. At step 729, the "ON"/"OFF" of the sheet paper detector (SW1) 42, that is, whether or not the output thereof is at the high level "H" or the low level "L", is decided. In summary, when the tip end of the recording paper when the same recording paper is directed to the heating and near IR irradiation unit 12 four times is detected by the paper detector (SW1) 42, the routine proceeds from step 729 to step 730, at which it is decided whether or not the time $T_2$ has elapsed. As already mentioned, the time $T_2$ is defined as a time required from when the tip end of the recording paper is detected by the sheet paper detector (SW1) 42 to when it reaches the position at which the sheet paper detector (SW2) 44 is disposed. When the time $T_2$ has elapsed, the routine proceeds to step 731, at which the "ON"/"OFF" of the sheet paper detector (SW2), that is, whether or not the output thereof is at the high level "H" or the low level "L", is decided. When the output of the sheet paper detector (SW2) 44 becomes the high level "H", that is, when the tip end of the recording paper is detected by the sheet paper detector (SW2) 44, this means that the recording paper safely passes the heating and near IR irradiation means 12 without an occurrence of paper jamming in the heating and near IR irradiation unit 12. When the sheet paper detector (SW2) 44 is "ON", the routine proceeds from step 732 to step 732, at which the "ON"/"OFF" of the sheet paper detector (SW2), that is, whether or not the output thereof is at the low level "L" or the high level "H", is decided. Namely, it is decided whether or not the rear end of such a recording paper passes the position at which the sheet paper detector (SW2) 44 is disposed. Subsequently, at step 733, it is decided whether or not the time $T_3$ has elapsed. The time $T_3$ is defined as a time required from when the rear end of the recording paper passes the sheet paper detector (SW2) 44 to when it is ejected on to the ejected paper stacker 48. After the time $T_3$ has elapsed, the routine proceeds from step 733 to step 734, at which the electromagnetic solenoid 56*b* is turned "OFF", and the curved flap 56*a* is returned from the broken line position to the solid line position (FIG. 3), and then the routine proceeds to step 717.

Where it is decided that the erasing processing is good when the same recording paper is repeatedly sent to the heating and near IR irradiation means 12 one to three times, at step 716, the counted number of the counter C is set as $1 \leqq C \leqq 3$, and at this time, the routine proceeds from step 716 to step 735, at which an indication lamp 114 encouraging the user to raise the voltage applied to the halogen lamp 12*b* is turned on. This is because, where it is decided that the erasing processing is good when the same recording paper is repeatedly sent to the heating and near IR irradiation means 12 one to three times, it is judged that the irradiation of the near infrared rays was not carried out well. Subsequently, after the counter C is reset at step 736, the routine proceeds to step 717.

In the above-mentioned embodiment, the set-up value of counter C at step 721 was made "3", but it is also possible even if the set-up value is 3 or less or 3 or more. Namely, it is OK so far as the recording paper is returned to the heating and near IR irradiation unit 12 at least one time or more when it is decided that the erasing processing of the recording paper is not good. On the other hand, it is also possible even if the recording paper is sent to either of the ejected paper stackers 48 and 80 only by an evaluation of first erasing processing of the recording paper. Namely, when the evaluation of the erasing processing when the recording paper is made to pass the heating and near IR irradiation unit 12 at first is not good, that recording paper is sent to the ejected paper stacker 48, and while when the evaluation of the erasing processing when the recording paper is made to pass the heating and near IR irradiation unit 12 at first is good, that recording paper is sent to the ejected paper stacker 80.

Note that, in the erasing apparatus shown in FIG. 2, it is assumed that the recording is carried out on the recording paper by anon-catalyst-containing recording agent composed of a near IR erasable dye, but the erasing processing of the recording paper on which the recording was carried out by a catalyst-containing recording agent is not be excluded. Namely, by performing the erasing processing by coating the liquid-state catalyst on the recording paper on which the recording is carried out by the catalyst-containing recording agent, it is possible to perform a smoother erasing processing.

Figure 10:
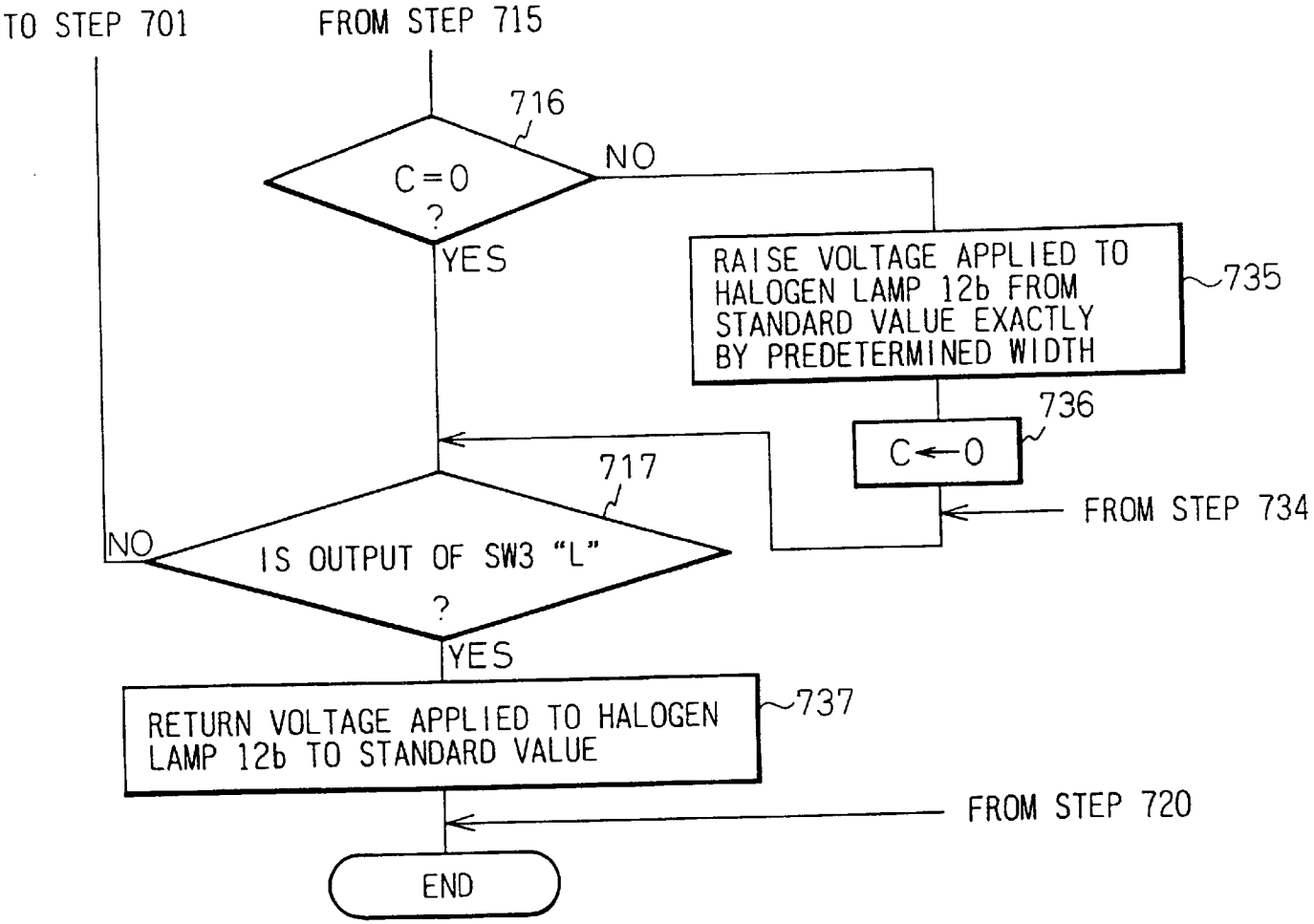
FIG. 10 is a flow chart showing a part of a modified example of the operation routine shown in FIG. 7 through FIG. 9.

Referring to FIG. 10, a modified example of the operation routine shown in FIG. 7 through FIG. 9 is indicated. In this modified example, at step 735, the voltage applied to the halogen lamp 12*b* is raised from a standard value by exactly a predetermined amount. This is carried out by controlling the power source circuit 102 by the control circuit 94. Also, after step 717, step 737 is added, at which the voltage applied to the halogen lamp 12*b* is returned to the standard value. In summary, in the operation routine shown in FIG. 10, where it is decided that the erasing processing is good in a case where the same recording paper is sent to the heating and near IR irradiation unit 12 one to three times, the voltage applied to the halogen lamp 12*b* is raised by exactly a predetermined amount, and when all of the recording papers in the paper feed hopper 30 are removed and the erasing processing is once ended, the voltage applied to the halogen lamp 12*b* is returned to the standard value.

Figure 11:
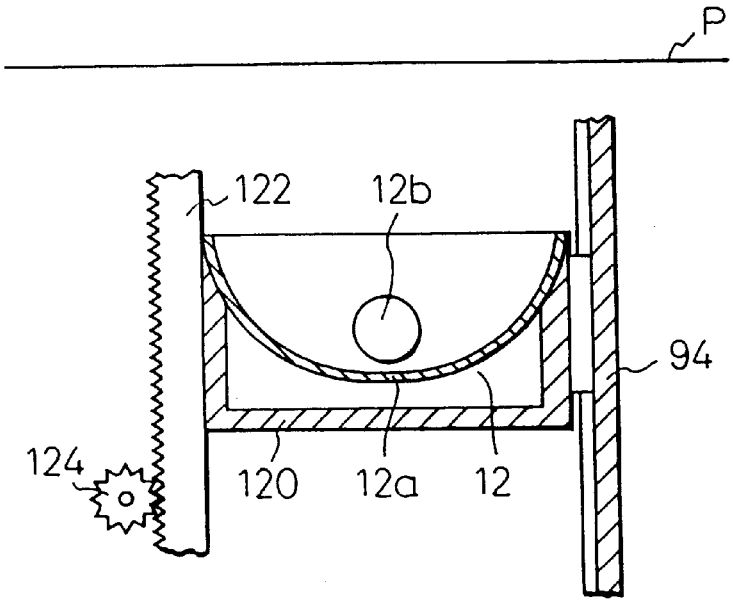
FIG. 11 is a schematic view showing a modified example of a heating and near IR irradiation unit shown in FIG. 2.

In the example of the operation routine shown in FIG. 10, the heating from the heating and near IR irradiation means 12 to the recording paper and control of the irradiation of near infrared rays were carried out by adjusting the voltage applied to the halogen lamp 12*b,* but it is also possible to make the heating and near IR irradiation unit 12 movable with respect to the sheet paper passage P as shown in FIG. 11 while maintaining the voltage applied to the halogen lamp 12*b* always constant, thereby to adjust the heating and the irradiation of the near infrared rays from the heating and near IR irradiation unit 12 to the recording paper. Explaining this in detail, in the embodiment shown in FIG. 11, the heating and near IR irradiation unit 12 is mounted on the movable carriage 120, and the movement in the front and rear directions of this movable carriage 120 with respect to the sheet paper passage P is regulated by the vertical guide rail 94. Also, a rack 122 extended in the vertical direction is attached to the movable carriage 120, and a pinion 124 is engaged with this rack 122. By bidirectionally driving the pinion 124, the heating and near IR irradiation means 12 approaches the sheet paper passage P or moves away from there, and therefore the heating and the irradiation of near infrared rays to the recording paper can be adjusted. For the driving of the pinion 124, an appropriate motor, for example, a pulse motor (not illustrated), is used, and it is also possible to perform the control of this pulse motor by manual manipulation of the user, or to perform the same by the control circuit 94.

Figure 12:
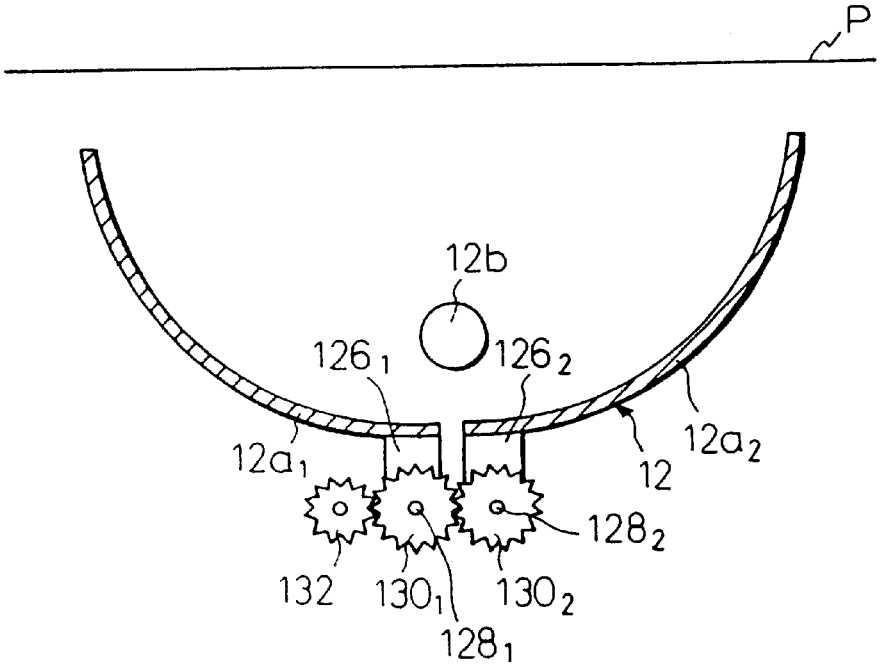
FIG. 12 is a schematic view showing another modified example of a heating and near IR irradiation unit shown in FIG. 2.

In the embodiment shown in FIG. 12, the reflecting concave surface mirror member 12*a* of the heating and near IR irradiation means 12 is divided into two parts 12 $a_1$ and 12 $a_2$ , and these two parts are attached onto block elements $\mathbf{126}_1$ and $\mathbf{126}_2$, respectively. These block elements are secured onto pivotably supported parallel shafts 128, and $\mathbf{128}_2$, respectively. Gears $\mathbf{130}_1$ and $\mathbf{130}_2$ are mounted on at least one end portion side of the parallel shafts $\mathbf{128}_1$ and $\mathbf{128}_2$, respectively. Either one of the gears $\mathbf{130}_1$ and $\mathbf{130}_2$ is engaged with the drive gear 132, and when this drive gear 132 is driven to rotate in any direction, two parts $\mathbf{12}a_1$ and $\mathbf{12}a_2$ are expanded or made narrower, so that the upward opening surface area thereof is adjusted, and thus the heating and the irradiation of near infrared rays from the heating and near IR irradiation unit 12 to the recording paper can be adjusted. For the control of the driving motor of the drive gear 132, in the same way as the case of the embodiment shown in FIG. 12, it is also possible to perform the same by manual manipulation of the user, or to perform the same by the control circuit 94.

Figure 13:
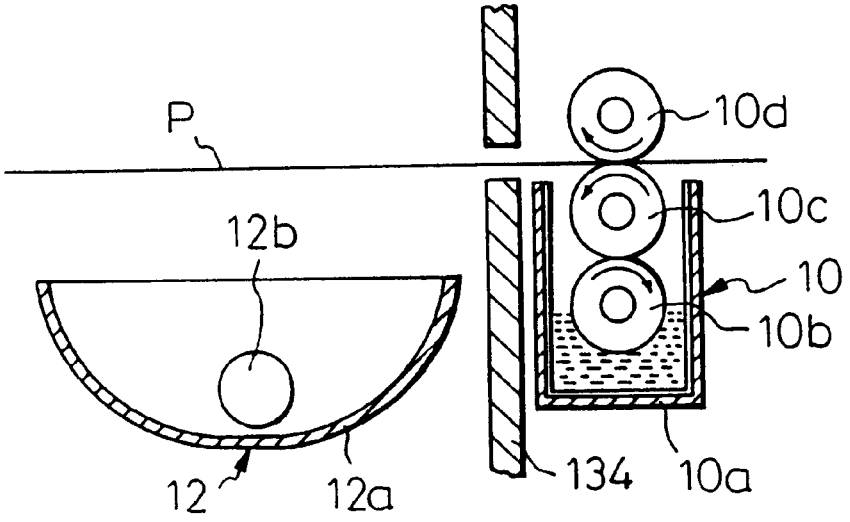
FIG. 13 is a schematic view showing a modified embodiment in which a heat insulating and shielding plate is provided between a liquid-state catalyst coating means and the heating and near IR irradiation unit shown in FIG. 2.

In the embodiment shown in FIG. 13, a heat insulating and shielding plate 134 is arranged between the liquid-state catalyst coating unit 10 and the heating and near IR irradiation unit 12. Thermal emission from the heating and near IR irradiation unit 12 to the liquid-state catalyst coating unit 10 is prohibited by this heat insulating and shielding plate 134, whereby an excess evaporation of solvent of the liquid-state catalyst retained in the retaining tank 10*a* of the liquid-state catalyst coating unit 10 can be prevented.

Figure 14:
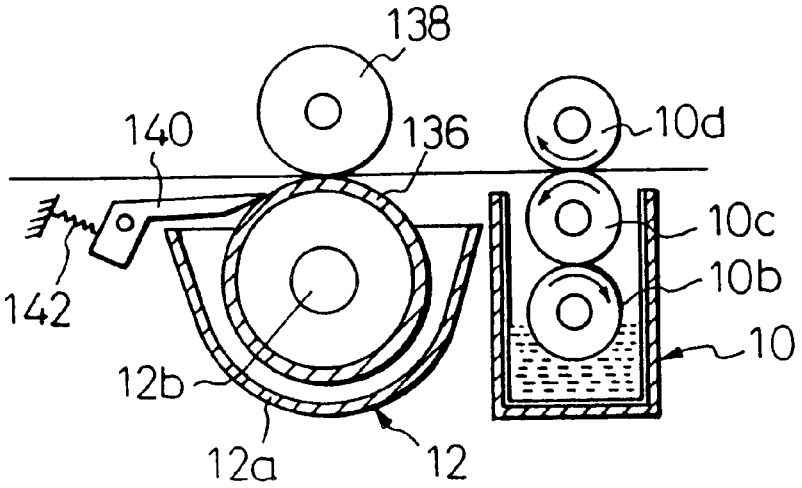
FIG. 14 is a schematic view showing a further example of the heating and near IR irradiation unit shown in FIG. 2.

In the embodiment shown in FIG. 2, the heat resistant glass plate 20 is dirtied with paper powder etc., and therefore the heat resistant glass plate 20 must be cleaned periodically so as to remove such paper powder etc. When the heat resistant glass plate 20 is dirtied with paper powder etc. and the amount of transmission of the near infrared rays is reduced, it becomes impossible to perform a proper erasing processing. In the embodiment shown in FIG. 14, a cylindrical light transmitting roller 136 is used in place of the heat resistant glass plate. Also, this cylindrical light transmitting roller 136 is formed by preferably the heat resistant glass material. A backup roller 138 is applied to the cylindrical light transmitting roller 136, and the recording paper is made to pass between the cylindrical light transmitting roller 136 and the backup roller 138. Note that, at the time of operation of the erasing apparatus, the cylindrical light transmitting roller 136 and the backup roller 138 are driven to rotate in directions indicated by the arrow in the figure, respectively. The concave reflecting member 12*a* of the heating and near IR irradiation unit 12 accommodates the cylindrical heat resistant glass roller 136, and the halogen lamp 12*b* thereof is arranged along a longitudinal direction thereof in the cylindrical light transmitting roller 136. As shown in FIG. 14, a pivotally secured scraper element 140 is engaged with the cylindrical light transmitting roller 136 as the cleaning element, and an appropriate tensile spring 142 is provided in this scraper element 140, whereby the scraper element 140 is resiliently brought into contact with the cylindrical light transmitting roller 136. According to such a structure, at the time of operation of the erasing apparatus, the surface of the cylindrical light transmitting roller 136 can be always cleaned by the scraper element 140.

Figure 15:
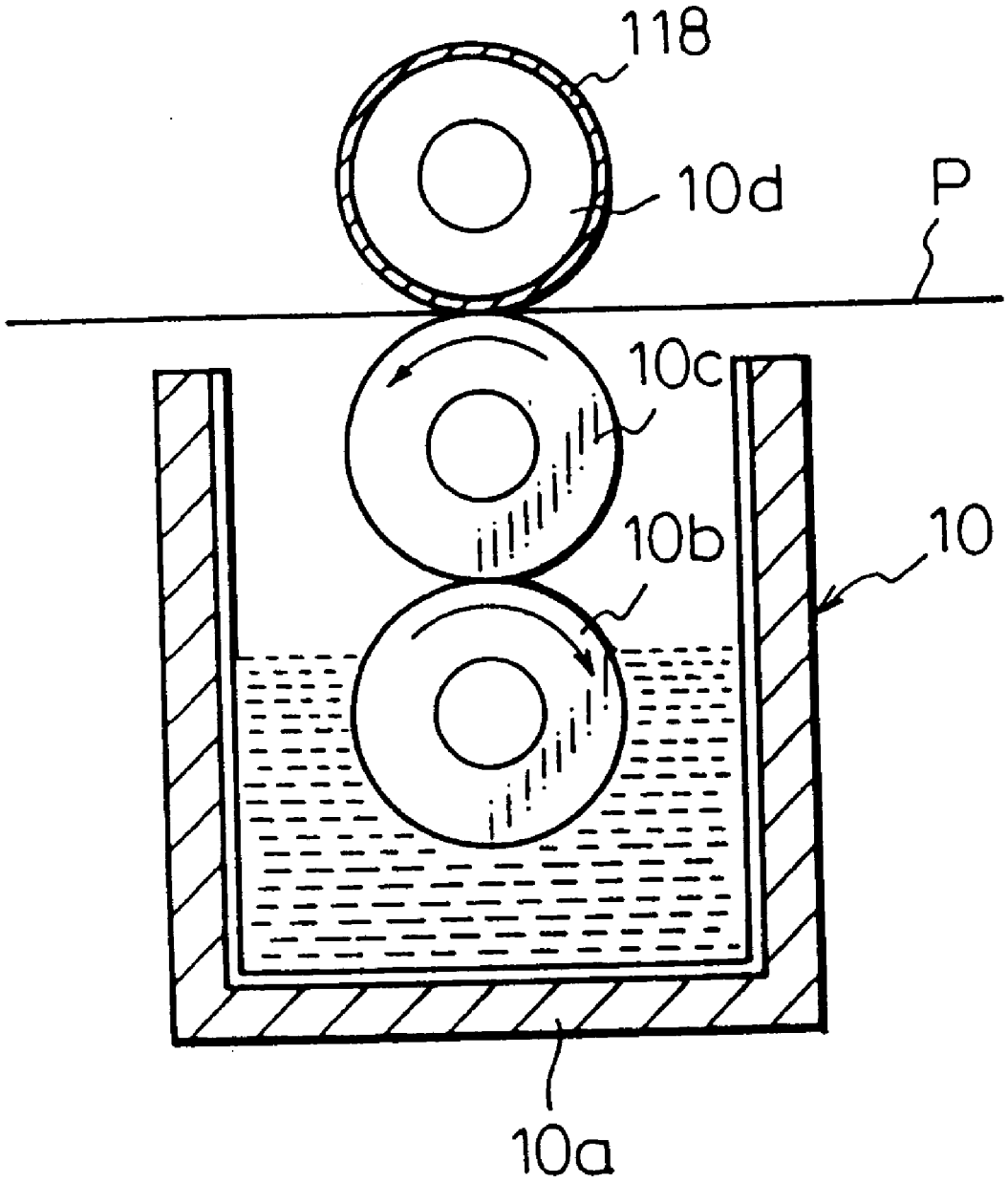
FIG. 15 is a schematic view showing another modified example of the liquid-state catalyst coating unit shown in FIG. 2.

When the recording paper is not passed between the middle roller 10*c* and upper roller 10*d* of the liquid-state catalyst coating unit 10, the liquid-state catalyst accompanying the middle roller 10*c* is moved also to the upper roller 10*d*. This liquid-state catalyst is coated on the top surface of the recording paper when the recording paper is introduced into a space between the middle roller 10*c* and the upper roller 10*d* and is uselessly consumed by that amount. So as to eliminate such a useless consumption of the liquid-state catalyst, preferably a water repellent processing is applied to the surface of the upper roller 10*d*. For example, as shown in FIG. 15, it is possible to apply a Teflon coating 144 to the upper roller 10*d*. In this case, the adhesion of the liquid-state catalyst to the surface of the upper roller 10*d* is suppressed to the minimum level due to the Teflon coating 144, whereby useless consumption of the liquid-state catalyst can be eliminated.

Figure 16:
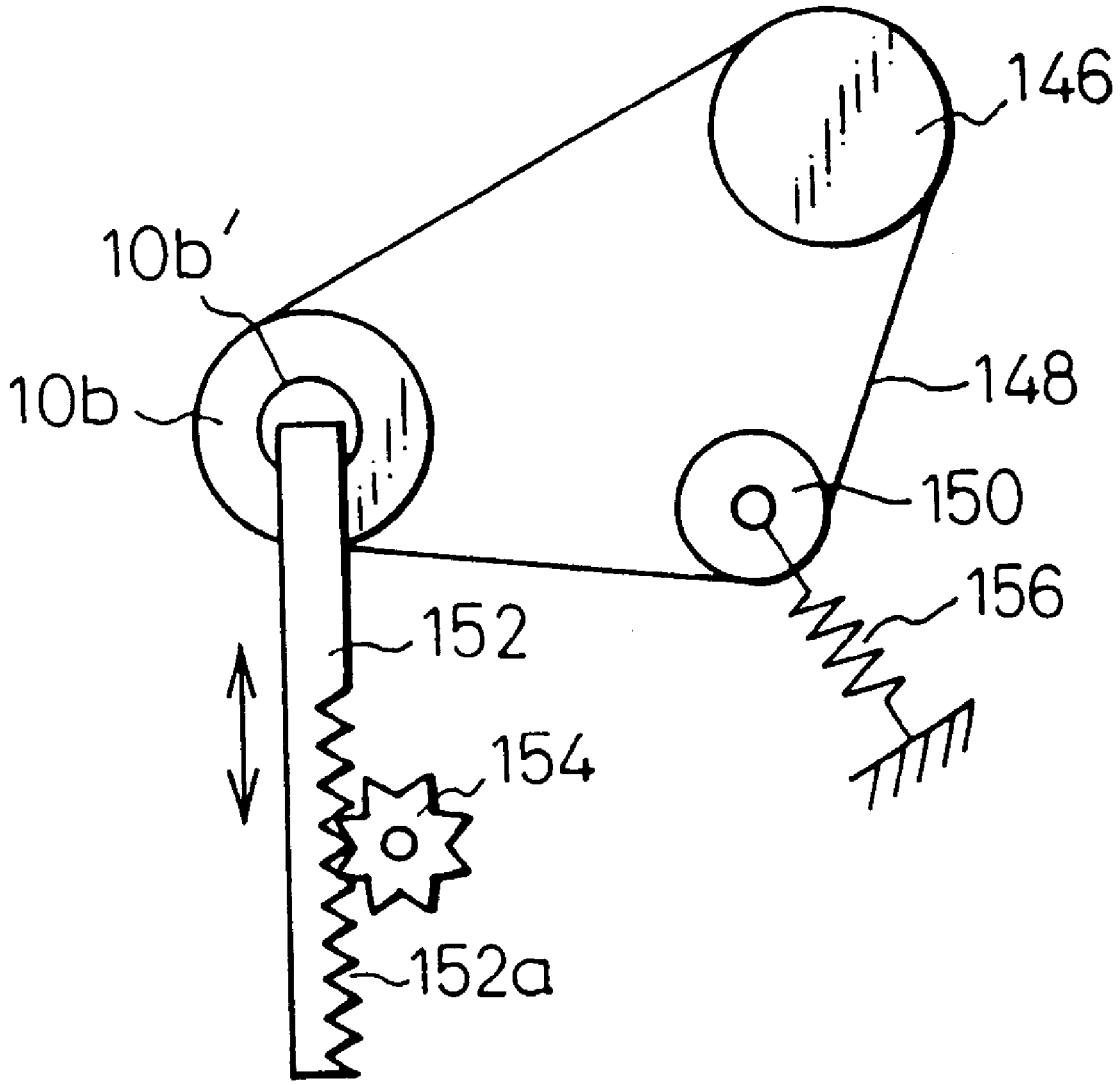
FIG. 16 is a schematic view showing an adjustment mechanism for adjusting the liquid-state coating amount by the liquid-state catalyst coating unit of FIG. 2.

So as to adjust the amount of coating of the liquid-state catalyst to the recording paper at the liquid-state catalyst coating unit 10, preferably the lower roller 10*b* is made to be freely displaced relative to the middle roller 10*c*. The adjustment of the amount of coating of the liquid-state catalyst is possible by changing the rotation speed of the roller assembly, but in this case, the feeding speed of the recording paper fluctuates, and therefore this method cannot be adopted. Therefore, as shown in FIG. 16, it is possible to perform the adjustment of the coating amount of the liquid-state catalyst without a fluctuation of the feeding speed of the recording paper by connecting the respective end portions of the lower roller 10*b* by a drive pulley 146 and an endless drive belt 148, and applying a tension pulley 150 to an appropriate position of the endless drive belt 148. Explaining this in detail, the lower roller 10*b* is rotatably disposed on its shaft 10*b*', and one end of a long length rack member 152 is fixed on both ends of the shaft 10*b*'. The long length rack member 152 is supported so that it can freely move in the vertical direction with respect to the appropriate guide member (not illustrated) as indicated by an arrow in the figure, and a pinion 154 is engaged with the rack gear 152*a* of the long length rack member 152. The tension pulley 150 receives a resilient biasing force of the tensile coil spring 156, whereby the endless drive belt 148 is always maintained in the tension state. The drive pulley 146 receives the rotation drive force from the main motor 96 (FIG. 6), and the pinion 154 is driven by an independent rotation drive source, for example, a pulse motor (not illustrated). According to such a structure, it is possible to adjust the nip width between the lower roller 10*b* and the middle roller 10*c* while maintaining a state where the lower roller 10*b* is driven to rotate at a constant speed, and by expanding the nip width, an amount of the liquid-state catalyst accompanying the middle roller 10*c* is increased, while by reducing the nip width, the amount of the liquid-state catalyst accompanying the middle roller 10*c* is decreased.

It is possible to incorporate the liquid-state catalyst coating amount adjustment mechanism shown in FIG. 16 in the liquid-state catalyst coating means 10 of the erasing apparatus shown in FIG. 2. At this time, at step 735 of the operation routine shown in FIG. 10, it is also possible to increase the amount of coating of the liquid-state catalyst with respect to the recording paper by exactly the predetermined amount simultaneously with when an voltage applied to the halogen lamp 12*b* is raised by a predetermined amount.

Figure 17:
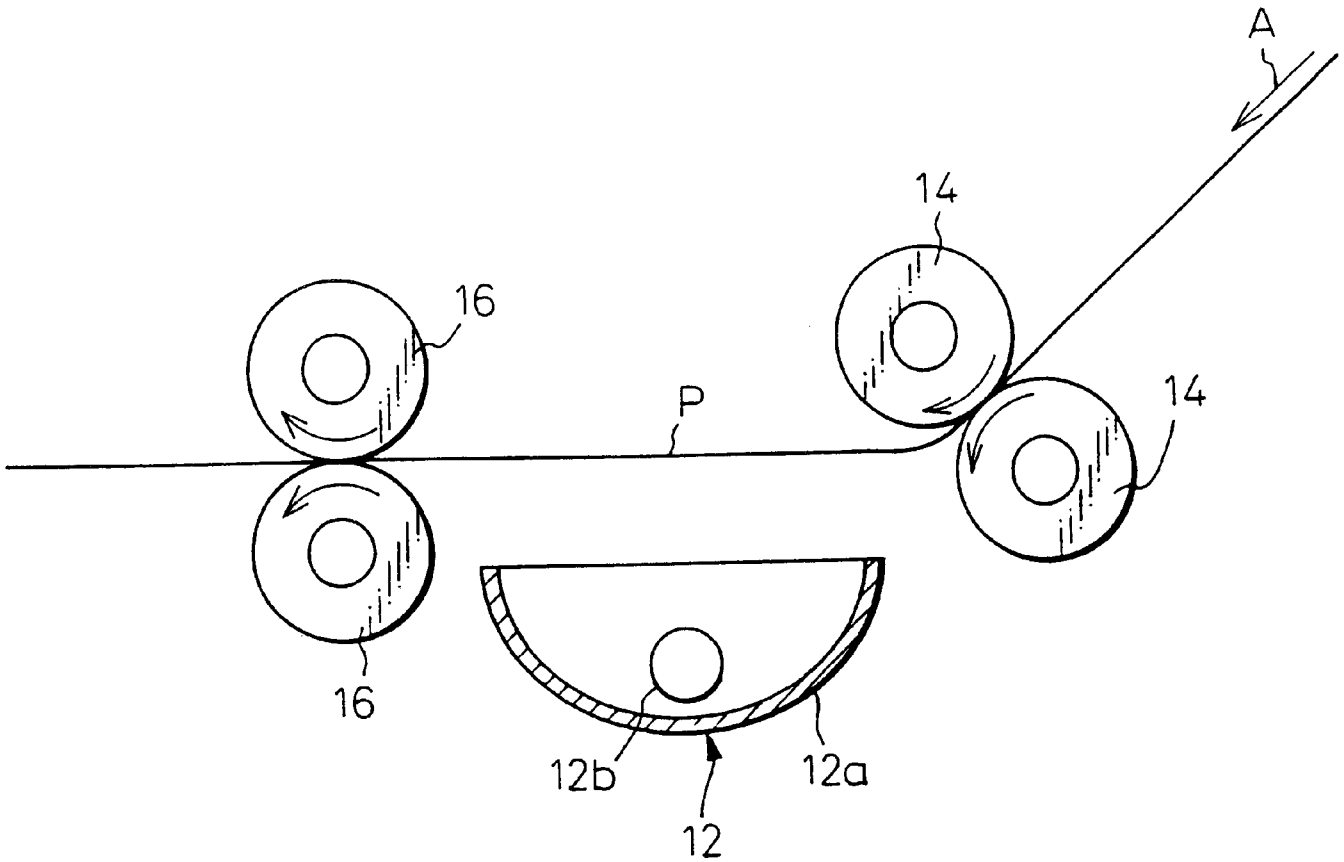
FIG. 17 is a schematic view showing the principle structure of the erasing apparatus for working an erasing method according to a second aspect of the present invention.

Referring to FIG. 17, the principle structure of the erasing apparatus for working the erasing method according to the second aspect of the present invention is shown. This erasing apparatus corresponds to an apparatus obtained by omitting the liquid-state catalyst coating unit 10 from the erasing apparatus shown in FIG. 1. In the erasing method according to the second aspect of the present invention, it is assumed that the recording is carried out on the recording paper by a catalyst-containing recording agent composed of a near IR erasable dye, and in this case, it is a characteristic feature that, at the time of erasing processing of the recording agent on the recording surface of the recording paper, the heating of the recording paper and the irradiation of the near infrared rays to the recording surface of the recording paper are simultaneously carried out by the heating and near IR irradiation unit 12. Namely, when the recording paper fed by the paper feed rollers 14 and 14 pass above the sheet paper passage P on the heating and near IR irradiation unit 12, the recording paper receives the irradiation of the near infrared rays simultaneously with the heating from the thermal emission and near IR irradiation source of the heating and near IR irradiation unit 12, that is, the halogen lamp 12*b*.

Note that, although it is possible to say the above-mentioned characteristic applies also for the case of the preferred embodiment shown in FIG. 1 and FIG. 2, it must be understood that the erasing method and erasing apparatus according to the first aspect of the present invention can stand even in a case where the heating source and the near IR irradiation source are individually provided. For example, as another embodiment of the erasing method and erasing apparatus according to the first aspect of the present invention, also an embodiment using a heat roller as the heating source and a light emitting diode array as the near IR irradiation source can stand.

Figure 18:
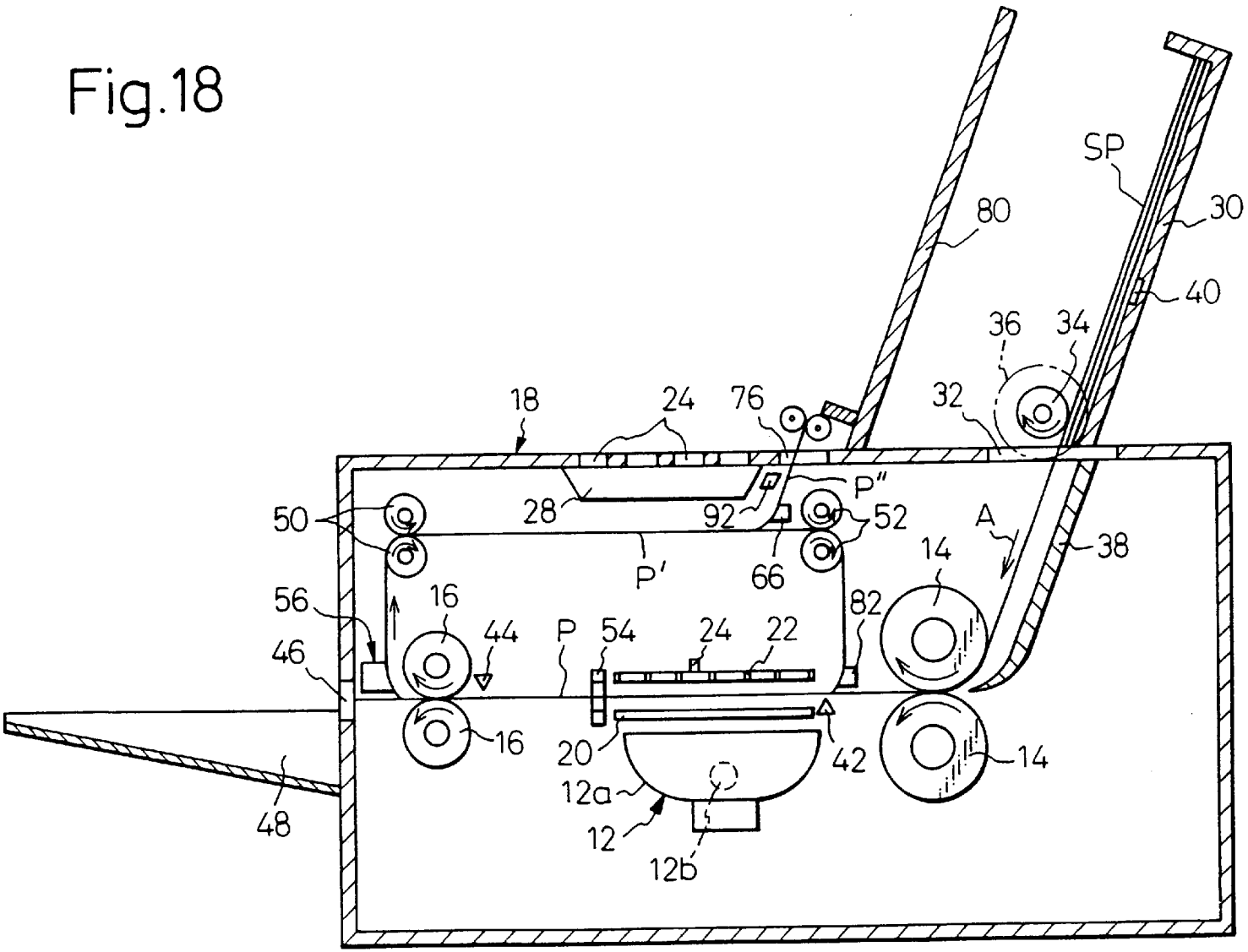
FIG. 18 is a schematic view showing a preferred embodiment of the erasing apparatus constituted according to the second aspect of the present invention.

Referring to FIG. 18, a preferred embodiment of the erasing apparatus according to the second aspect by the present invention is shown. Also in this erasing apparatus, the erasing method of FIG. 17 is worked. The erasing apparatus of FIG. 18 corresponds to that obtained by omitting the liquid-state catalyst coating unit 10 from the erasing apparatus shown in FIG. 2. In FIG. 18, the same reference numerals are used for parts of the structure similar to those of the erasing apparatus of FIG. 2. Moreover, also the operation of the erasing apparatus can be explained by the same aspect as the operation routines shown in FIG. 7 through FIG. 9 and FIG. 10.

Figure 19:
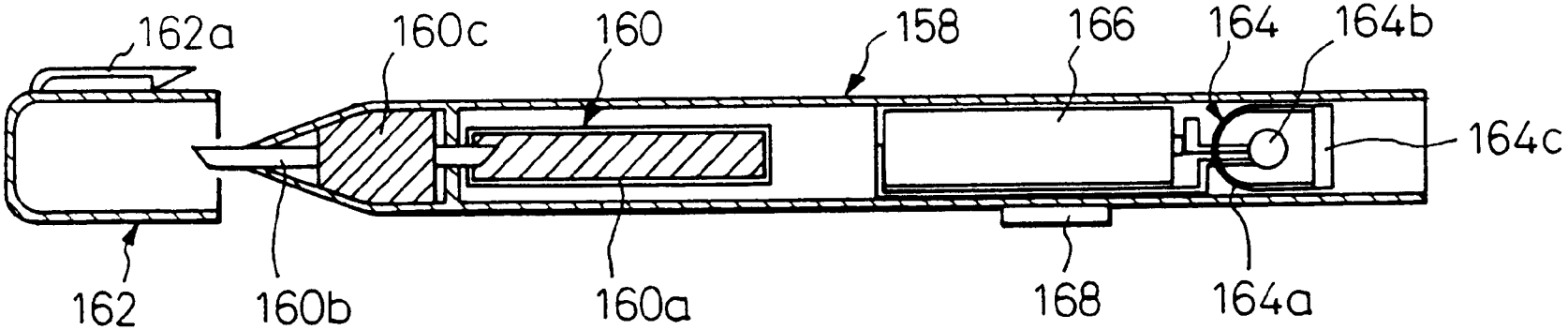
FIG. 19 is a vertical cross-sectional view showing one embodiment of a portable erasing apparatus according to the present invention.

It can be sufficiently considered that the writing be carried out on the recording paper on which the recording is carried out by a recording agent composed of a near IR erasable dye by a writing tool, and at this time, also such a writing tool must be one using the near IR erasable dye so as to guarantee the reuse of the recording paper. Where one writes on a recording paper using a writing tool, of course, one will sometimes make errors in writing or the like, and therefore preferably such a writing error etc. can be easily erased. FIG. 19 shows a portable erasing apparatus. The overall erasing apparatus exhibits the shape of a writing tool. Explaining this in detail, the portable erasing apparatus is provided with a cylindrical casing 158, and a liquid-state catalyst coating means 160 is provided in a half part of this cylindrical casing 158. The liquid-state catalyst coating means 160 is provided with a retaining tank 160*a* retaining the liquid-state catalyst and a hard felt element 160*b* extended from this retaining tank 160*a*. As illustrated, one end of the hard felt element 160*b* is protruded from one end of the cylindrical casing 158, and an intermediate part thereof is covered by the sponge material 160*c*. A large number of capillary tubes are included in the hard felt element 160*b*, whereby the liquid-state catalyst in the retaining tank 160*a* is carried through the hard felt element 160*b* to the protruded end portion thereof, and at this time, a sufficient liquid-state catalyst is stocked in the sponge material 160*c*. When the portable erasing apparatus is not used, the protruded end portion of the hard felt element 160*b* is covered by the cap 162, and a clip 162*a* is preferably provided in this cap 162 in the same way as the case of the cap of the fountain pen.

A heating and near IR irradiation unit 164 is provided in the opposite side half of the cylindrical casing 158, and this heating and near IR irradiation unit 164 is provided with a concave surface reflecting mirror element 164*a* and a halogen lamp 164*b* arranged at the focus of this concave surface reflecting mirror element 164*a*. A transparent glass 164*c* is provided in the opening of the concave surface reflecting mirror element 164*a*, whereby the halogen lamp 164*b* is protected. Also, a dry battery 166 is accommodated as the power source of the halogen lamp 164*b* in such a half of the cylindrical casing 158, and the supply of electrical power from the dry battery 166 to the halogen lamp 164*b* is selectively carried out by the ON/OFF switch 168.

When simply mentioning the state of use of the portable erasing apparatus, first the cap 162 is removed from the cylindrical casing 158, and the liquid-state catalyst is coated on the writing error etc. on the recording paper by the protruded tip end of the hard felt element 160*b*. Subsequently, the halogen lamp is turned on by the ON/OFF switch 168, and the irradiation of the near infrared rays is carried out on such a liquid-state catalyst-coated surface and, at the same time, heat is given therefrom. Thus, it is possible to easily perform the erasing of the writing error etc.

Figure 20:
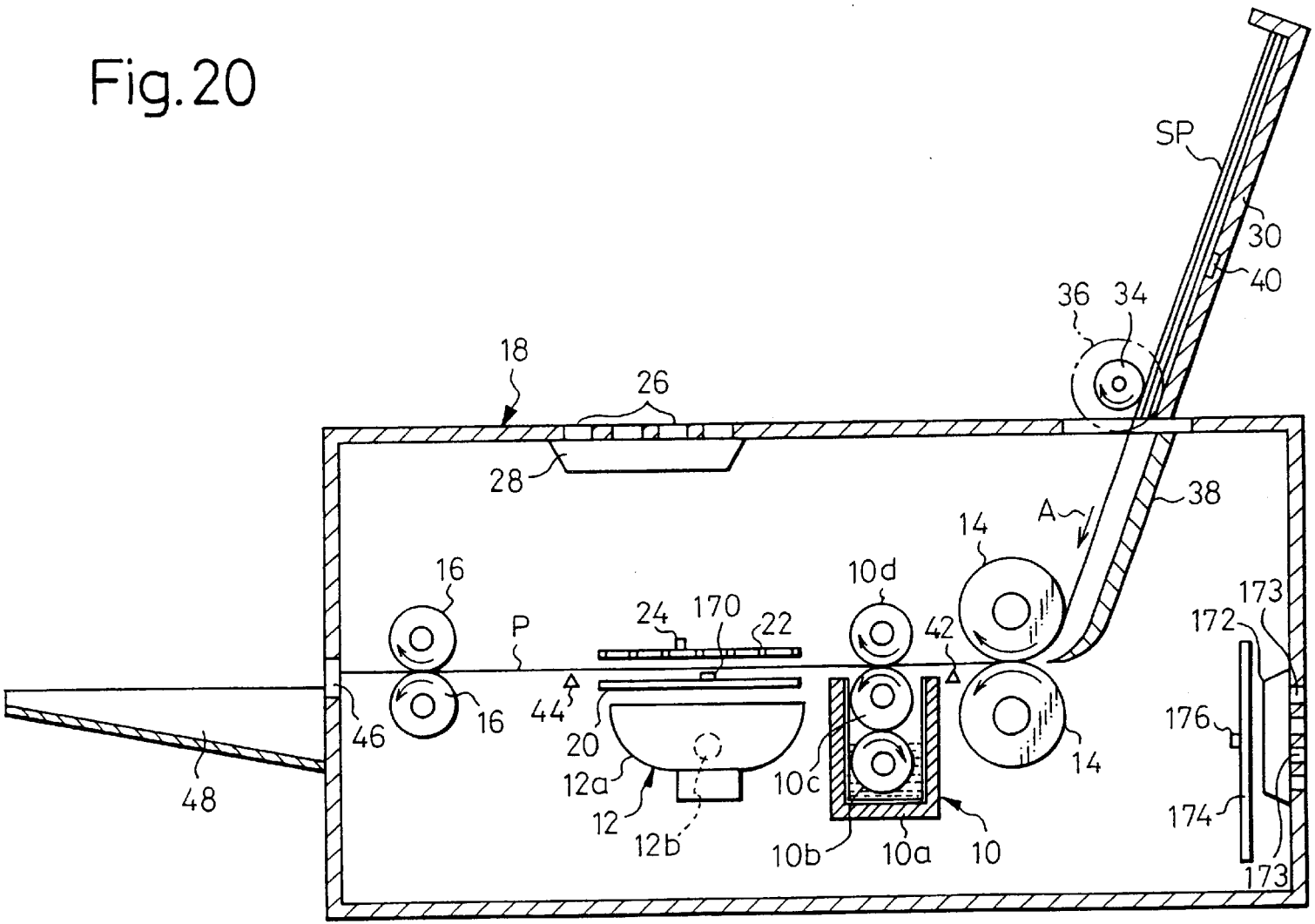
FIG. 20 is a schematic view showing another preferred embodiment of the erasing apparatus constituted according to the first aspect of the present invention.

FIG. 20 shows another preferred embodiment of the erasing apparatus constituted according to the first aspect of the present invention, which embodiment is basically the same as the erasing apparatus shown in FIG. 2, but in the embodiment of FIG. 20, the erasing processing can be quickly and efficiently carried out in comparison with the embodiment of FIG. 2. In FIG. 20, the same reference numerals are used for the same constituent elements as those of the erasing apparatus shown in FIG. 2, and also the function of these constituent elements is substantially the same. Moreover, also in FIG. 20, the reference symbol P denotes the sheet paper passage of the recording medium of the recording paper etc., reference symbol SP denotes a bundle SP of the recording papers mounted on the paper feed hopper 30, and an arrow A denotes the movement direction of the recording paper from the paper feed hopper 30.

The erasing apparatus of FIG. 20 differs from the erasing apparatus of FIG. 2 in the following points.

(1) In the erasing apparatus of FIG. 2, the sheet paper circulation path P' is provided, but in the erasing apparatus of FIG. 20, such a sheet paper circulation path is omitted so as to quickly and efficiently perform the erasing processing. Namely, in the erasing apparatus of FIG. 20, each recording paper receives the erasing processing only one time.

(2) In the erasing apparatus of FIG. 2, the sheet paper detector, that is, the contact switch 42 is arranged between the liquid-state catalyst coating unit 10 and the heating and near IR irradiation unit 12, and the sheet paper detector, that is the contact switch 44 is arranged close to a pair of sheet paper feeding rollers 16 and 16, but in the embodiment of FIG. 20, the contact switch 42 is arranged between the liquid-state catalyst coating unit 10 and a pair of paper feed rollers 14 and 14, and the contact switch 44 is arranged close to the heating and near IR irradiation unit 12 side.

(3) In the erasing apparatus of FIG. 2, the erasing processing speed (that is, the feeding speed of the recording paper) was made constant, but in the erasing apparatus of FIG. 20, the erasing processing speed is made variable in accordance with the change of the erasing processing temperature. Also, in the erasing apparatus of FIG. 20, so as to safely perform the erasing processing operation, the erasing processing temperature is monitored at two positions. Namely, on one side, the temperature of the metal plate 22 is detected by the temperature sensor 24, and on the other side, the temperature sensor 170 is provided on the heat resistant glass plate 20 so as to detect the temperature of the heat resistant glass plate 20 with which the recording surface of the recording paper comes into direct contact. Note that, the mounting position of the temperature sensor 170 is made a side edge at a distance from the passage of the recording paper on the heat insulating glass plate 20.

(4) In the erasing apparatus of FIG. 20, in addition to the cooling fan 28 provided on the top wall part of the housing 18, a cooling fan 172 is provided also on the side wall part of the housing 18, and a large number of perforations 173 are formed at the mounting position of the cooling fan 172 at the side wall part. The cooling fan 28 is driven so as to eject the heated air in the housing 18, while the cooling fan 172 is driven so as to introduce an outside cold air into the housing 18. Accordingly, when both of the cooling fans 28 and 172 are simultaneously driven, the external air positively permeates through the housing 18, and therefore a large cooling effect is obtained. Also, in the erasing apparatus of FIG. 20, the control circuit substrate 174 for controlling its operation is arranged adjoining the cooling fan 172, and in addition, a temperature sensor 176 for detecting the temperature of the control circuit substrate 174 is provided in the control circuit substrate 174. Note that, generally, so as to guarantee the operation reliability of the control circuit substrate 174, the temperature thereof must be maintained at 70° C. or less.

Figure 21:
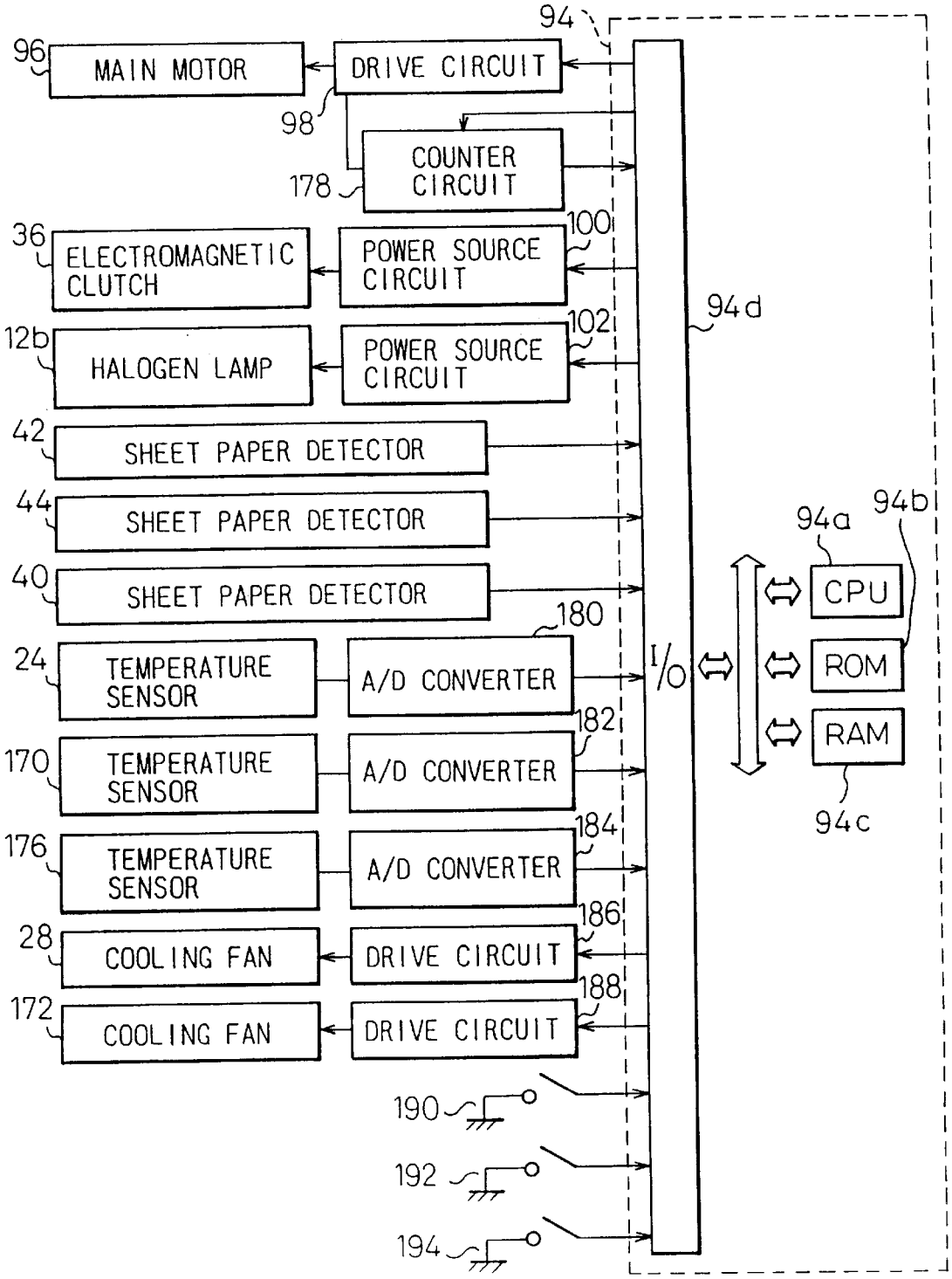
FIG. 21 is a block diagram of the control of the erasing apparatus of FIG. 20.

Referring to FIG. 21, there is shown a block diagram of the control of the erasing apparatus of FIG. 20, which block diagram of control corresponds to the block diagram of controls shown in FIG. 6. Note that, in FIG. 21, the same reference symbols are used for the same constituent elements as those of FIG. 6. The control circuit 94 shown in the block diagram of control of FIG. 21 is constituted by a microcomputer, which microcomputer includes a central processing unit (CPU) 94*a,* an operation program, a read only memory (ROM) 94*b* storing constants etc., a random access memory (RAM) 94*c* storing temporary data etc., and an input/output (I/O) interface 94*d.*

In FIG. 21, in the same way as in FIG. 6, reference numeral 96 denotes a main motor of the erasing apparatus, for example, a pulse motor, which main motor 96 is used as a drive source of the roller assembly of the liquid-state catalyst coating unit 10, the paper feed roller 14, the sheet paper feeding roller 16, the feed out roller 34, etc. The main motor 96 is driven by the drive pulse from the drive circuit 98, which drive circuit 98 is controlled so as to drive the main motor 96 by variable speed of three stages by a control signal output from the control circuit 94 via the I/O 94*d.* Namely, the main motor 96 is driven by either of the low speed level, middle speed level, or the high speed level. Also, the drive circuit 98 is connected to the I/O 94*d* via the counter circuit 176 counting the drive pulse output therefrom to the main motor 96, and the reset signal is appropriately output to the counter circuit 176 via the I/O 94*d* from the control circuit 94. In summary, the control circuit 94 can appropriately fetch the drive amount of the main motor 96 as the data. The electromagnetic clutch 36 is actuated by the power source circuit 100, and this power source circuit 100 is controlled by the control circuit 94 via the I/O 94*d.* The halogen lamp 12*b* is turned on by the power source circuit 102, and this power source circuit 102 is controlled by the control signal output from the control circuit 94 via the I/O 94*d* so as to turn on the halogen lamp 12*b* by two stages of voltage level. Namely, the halogen lamp 12*b* is selectively turned on by the voltage levels of two stages of a high level voltage, that is, a standard voltage of 100 volts, and a low level voltage, for example, 60 volts. The sheet paper detector, that is, contact switches 42, 44, and 40, are connected to the I/O 94*d* of the control circuit 94, and when the respective contact switches are "OFF", the output signals thereof are at the low level "L", but when the respective contact switches are turned "ON", the output signals are changed from the low level "L" to the high level "H". The outputs of the temperature sensors (thermistors) 24, 170, and 176 are converted to digital signals by the A/D converters 180, 182, and 184, respectively, and then fetched into the control circuit 94 via the I/O 94*d.* The cooling fans 28 and 172 are actuated by the drive circuits 186 and 188, respectively, and the respective drive circuits 186 and 188 are controlled by the control circuit 94 through the I/O 94*d.* Note that, in FIG. 21, reference numerals 190, 192, and 194 indicate various switches provided in an operation panel plate (not illustrated) of the erasing apparatus of FIG. 20, the switch 190 is a power source switch of the erasing apparatus, the switch 192 is the preheating switch for optionally performing the preheating of the erasing apparatus so as to speed up the startup of the erasing apparatus, and the switch 194 is the start switch for making the erasing apparatus perform the erasing processing operation.

Figure 22:
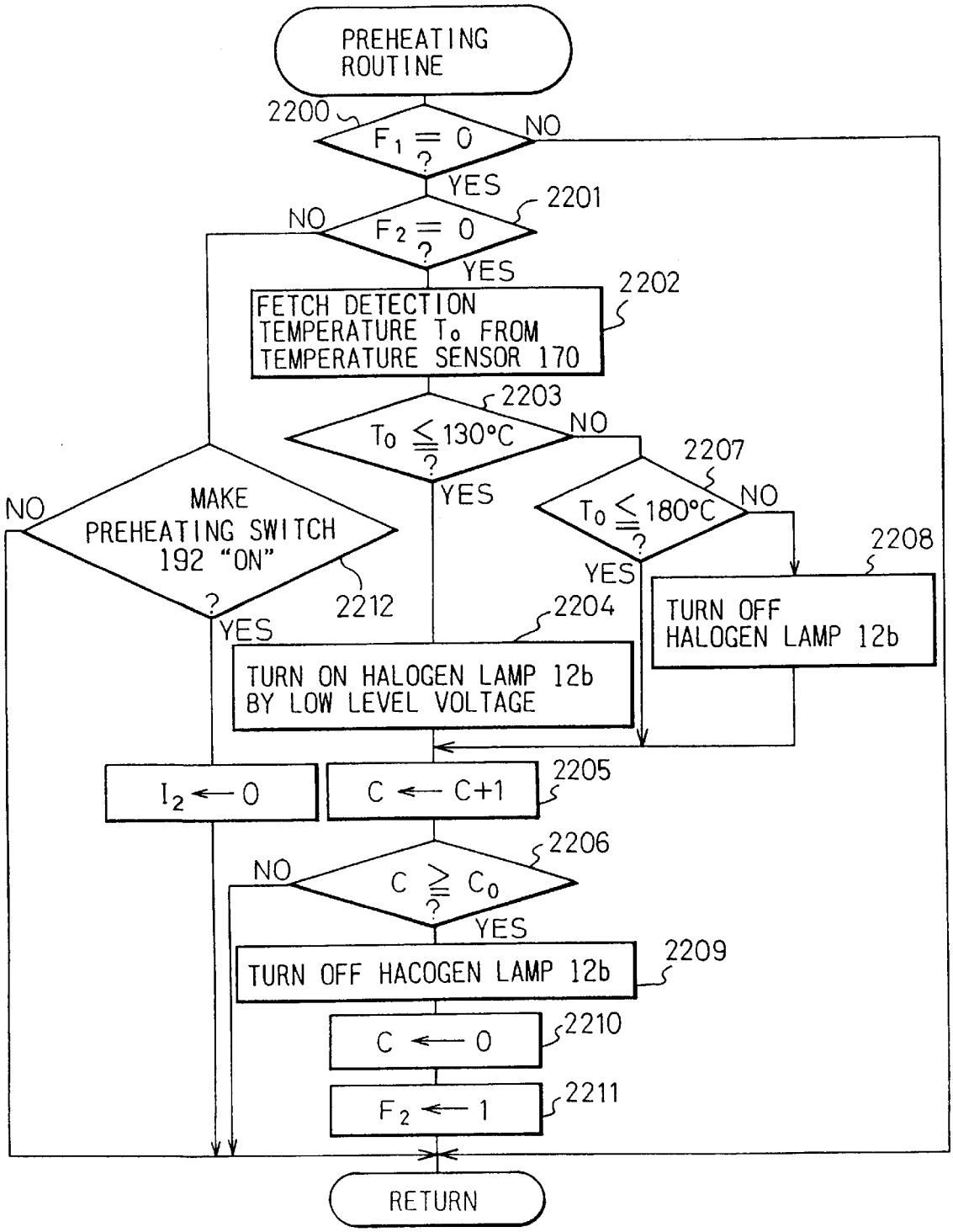
FIG. 22 is a flow chart showing a preheating routine for explaining the preheating operation of the erasing apparatus of FIG. 20.

An explanation will be made next of the preheating operation of the erasing apparatus of FIG. 20 referring to the preheating routine shown in FIG. 22. Note that, the preheating routine of FIG. 22 is an interruption routine executed at every predetermined time interval, for example, every 10 ms, by turning "ON" the power source switch 190.

First, at step 2200, it is decided whether the flag $F_1$ is "0" or "1". In the initial state, $F_1$=0, and therefore the routine proceeds to step 2201, at which it is decided whether the flag $F_2$ is "0" or "1". In the initial state, $F_2$=0, and therefore the routine proceeds to step 2202, at which that detection temperature $T_0$ is fetched from the temperature sensor 170 into the control circuit 94 via the A/D converter 182. Subsequently, at step 2203, the detection temperature $T_0$ is compared with for example 130° C., and when $T_0 \leqq 130°$ C., the routine proceeds to step 2204, at which the halogen lamp 12*b* is turned on by a low level voltage, for example, 60 volts. At step 2205, the value of the counter C (0 in the initial state) is counted up exactly by "1", and subsequently, the value of the counter C is compared with the predetermined constant $C_0$ at step 2206. When $C \geqq C_0$, the preheating routine is once ended. Note that, the constant $C_0$ is preliminarily stored in the ROM 94*b,* and that value is set to for example 20,000. Thereafter, the preheating routine is repeatedly executed at every 10 ms, and so far as the detection temperature $T_0$ of the temperature sensor 170 is 130° C. or less, the value of the counter C is merely counted up by "1" each time, and during this time, the temperature of the heat resistant glass 20 is gradually raised by the turning on of the halogen lamp 12*b.*

When $T_{10}$ becomes larger than 130° C. at step 2203, the routine proceeds from step 2203 to step 2207, at which the detection temperature $T_0$ of the temperature sensor 170 is compared with for example 180° C., and when $T_0 \leqq 180°$ C., the routine proceeds to step 2205, at which the value of the counter C is counted up exactly by "1", and subsequently the value of the counter C is compared with the predetermined constant $C_0$ at step 2206. When $C \geqq C_0$, the preheating routine is once ended. Thereafter, the preheating routine is repeatedly executed at every 10 ms, but so far as the detection temperature $T_0$ of the temperature sensor 170 is 180° C. or less, the value of the counter C is merely counted up by "1" each time, and during this time, the temperature of the heat resistant glass 20 is further raised by the turning on of the halogen lamp 12*b.*

When $T_{10}$ becomes larger than 180° C. at step 2207, the routine proceeds from step 2207 to step 2208, at which the halogen lamp 12*b* is turned on. Subsequently the routine proceeds to step 2205, at which the value of the counter C is counted up exactly by "1", and subsequently the value of the counter C is compared with the predetermined constant $C_0$ at step 2206. When $C \geqq C_0$, the preheating routine is once ended. Thereafter, the preheating routine is repeatedly executed at every 10 ms, but so far as the detection temperature $T_0$ of the temperature sensor 170 is not lowered to 130° C. or less, the value of the counter C is merely counted up by "1" each time. When the detection temperature $T_0$ of the temperature sensor 170 becomes 130° C. or less again, the halogen lamp 12*b* is turned on by the low level voltage (60 volts). In summary, the heat resistant glass 20 is preheated by the turning on of the halogen lamp 12*b*, and the preheating temperature thereof is maintained within a range of from 130 through 180° C.

When the value of the counter C reaches 20,000, that is, when 20 minutes (20,000×10 ms) has elapsed from a point of time when the power source switch 190 is turned "ON", the routine proceeds from step 2206 to step 2209, at which the halogen lamp 12*b* is turned off. Note that, when the halogen lamp 12*b* is in an off state at a point of time when the value of the counter C reaches 20,000, at step 2209, that turning off state is maintained. Subsequently, the counter C is reset at step 2210, and subsequently the flag $F_2$ is rewritten to "1" at step 2211, and then the preheating routine is once ended. Thereafter, the preheating routine is repeatedly executed at every 10 ms, and at this time, $F_2$=1, and therefore the routine proceeds from step 2202 to step 2212, at which it is decided whether or not the preheating switch 192 is turned "ON". When the preheating switch 192 is turned "ON" by the user, the routine proceeds from step 2212 to step 2213, at which the flag $F_2$ is rewritten to "0", and thereafter the preheating of the heat resistant glass 20 is carried out again for 20 minutes. On the other hand, unless the preheating switch 192 is turned "ON", the preheating routine merely passes steps 2201, 2202, and 2212, and no advance occurs.

Note that, it goes without saying that the preheating operation as mentioned above can be similarly applied also to the erasing apparatus shown in each of FIG. 2 and FIG. 18.

Figure 23:
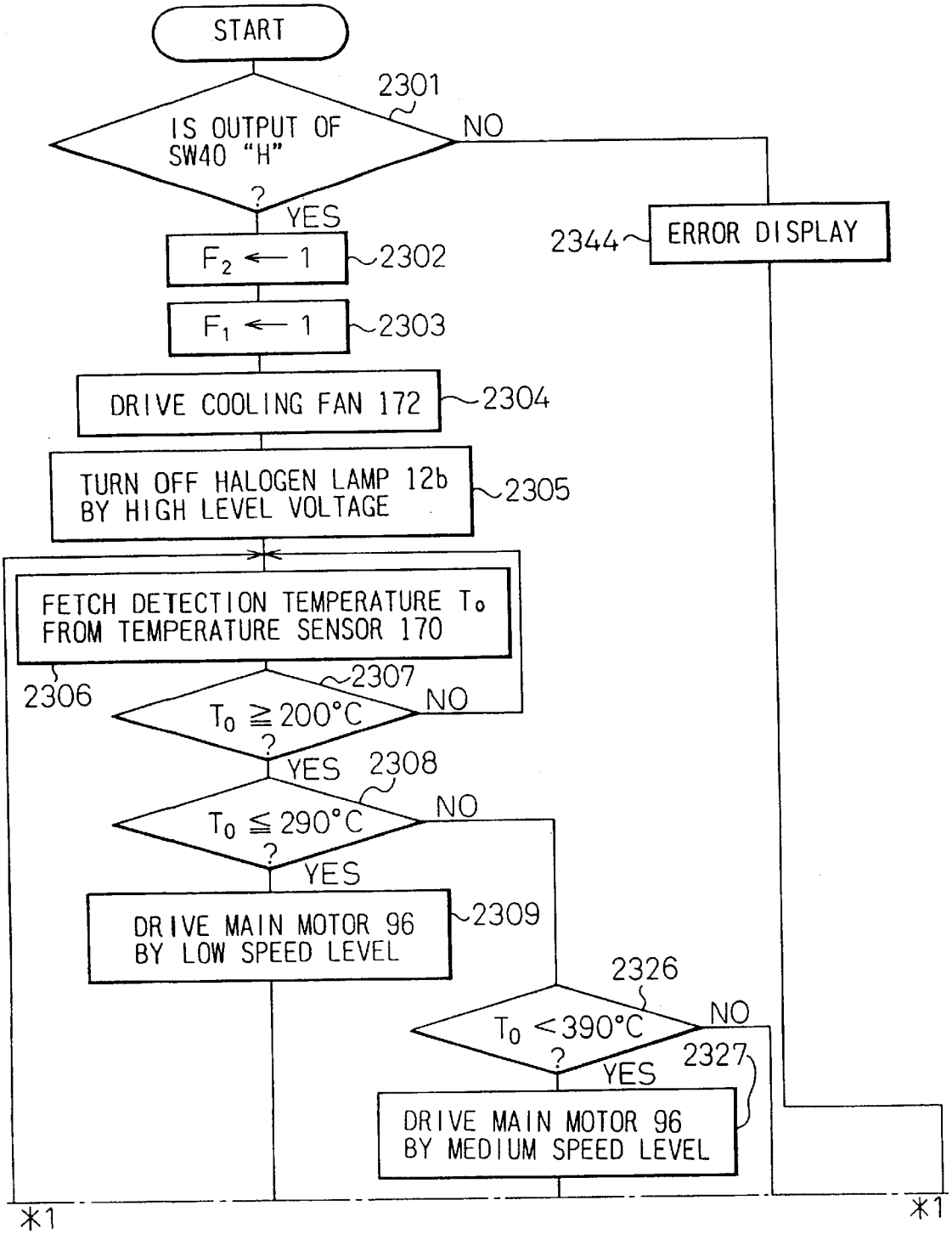
FIG. 23 is a flow chart showing a part of the operation routine for explaining the operation of the erasing apparatus of FIG. 20.
Figure 24:
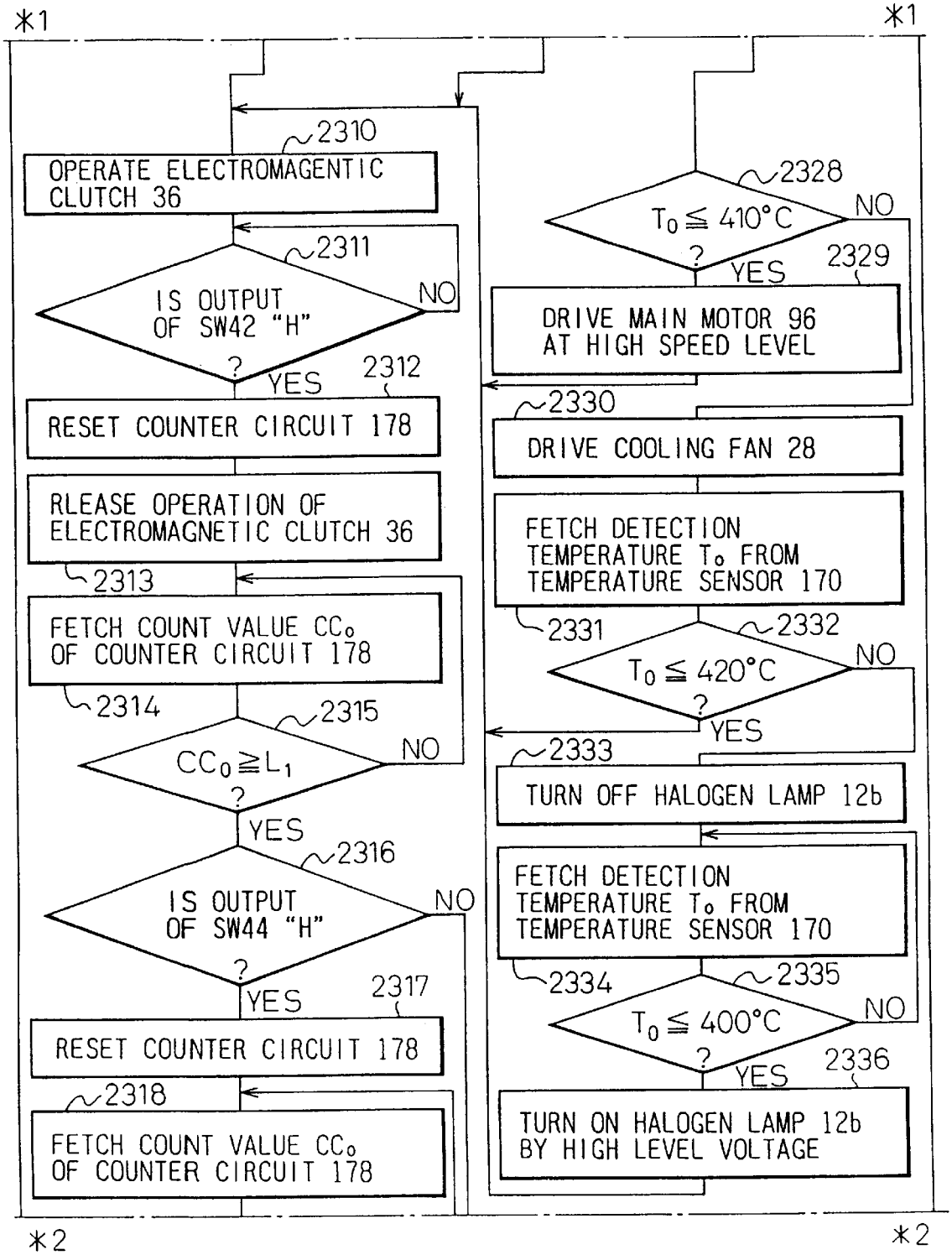
FIG. 24 is a flow chart showing a part of the operation routine for explaining the operation of the erasing apparatus of FIG. 20.
Figure 25:
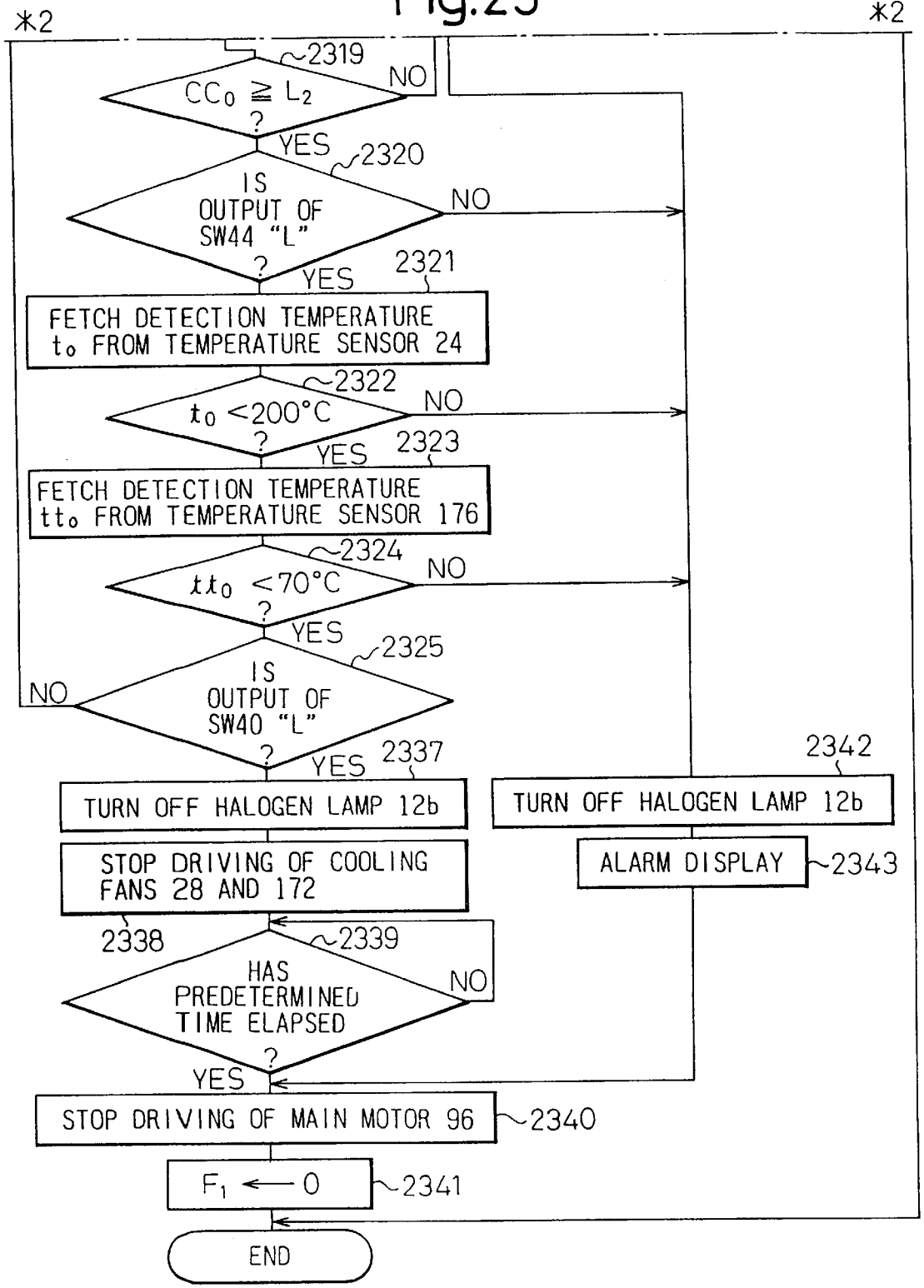
FIG. 25 is a flow chart showing a part of the operation routine for explaining the operation of the erasing apparatus of FIG. 20.

An explanation will be made next of the operation of the erasing apparatus of FIG. 20 by referring to the routine shown in FIG. 23 through FIG. 25. Note that, the operation routine is executed by turning "ON" the start switch 194.

First, at step 2301, it is decided whether or not the output of the sheet paper detector (micro switch) 40 is at the high level "H" or the low level "L", that is, whether or not the recording paper is mounted in the paper feed hopper 30. When the recording paper is mounted in the paper feed hopper 30, that is, when the output of the sheet paper detector 40 is at the high level "H", the routine proceeds to step 2302.

At step 2302, the flag $F_1$ is rewritten to "1", whereby even during a term for which the heat resistant glass plate 20 is preheated (FIG. 22), that preheating is immediately stopped. Subsequently, at step 2303, the flag $F_1$ is rewritten to "1", whereby even if the preheating switch 192 is erroneously turned "ON" during the operation of the erasing apparatus, the preheating by the preheating routine is subsequently prohibited. Namely, even during the operation of the erasing apparatus, the preheating routine of FIG. 22 is executed at every 10 ms, but ended merely after passing step 2201.

At step 2304, the cooling fan 172 is driven, and subsequently, at step 2304, the halogen lamp 12*b* is turned on by a high level voltage, that is, a standard voltage of 100 volts. At step 2306, the detection temperature $T_0$ of the temperature sensor 170 is fetched therefrom into the control circuit 94 via the A/D converter 182, and subsequently the detection temperature $T_0$ is compared with for example 200° C. at step 2307. When $T_0$<200° C., it is returned to step 2206. Namely, at step 2307, it is monitored whether or not the temperature of the heat resistant glass plate 20 reaches 200° C. Where the preheating operation as mentioned above is carried out, the temperature of the heat resistant glass plate 20 can smoothly reach 200° C.

At step 2307, when the temperature of the heat resistant glass plate 20 reaches 200° C., the routine proceeds to step 2308, at which the detection temperature $T_0$ of the temperature sensor 170 is compared with for example 290° C. When $T_0$<290° C., the routine proceeds to step 2309, at which the main motor 96 is driven at the low speed level there. Subsequently, at step 2310, the electromagnetic clutch 36 is actuated, whereby the feed out roller 34 is driven, so that only one sheet of recording paper is fed out of the stack SP in the paper feed hopper 30, and this recording paper is guided to the paper feed rollers 14 and 14 by the guide plate 38 provided in the housing 18.

At step 2311, the rising of the output of the sheet paper detector 42 from the low level "L" to the high level "H" is monitored. When the output of the sheet paper detector 42 becomes the high level "H", that is, when the tip end of the recording paper is detected by the sheet paper detector 42, the routine proceeds to step 2312, at which the counter circuit 178 is reset, and subsequently the operation of the electromagnetic clutch 36 is released at step 2312. Thereafter, the recording paper is fed by the paper feed rollers 14 and 14, and at the time of passing of the liquid-state catalyst coating means 10, the liquid-state catalyst is coated on the recording surface of the recording paper, and subsequently the recording paper receives the irradiation of the near infrared rays by the heating and near IR irradiation unit 12 and, at the same time, heated, and the recording surface of the recording paper receives the erasing processing.

At step 2314, the count value $CC_0$ is fetched from the counter circuit 178 into the control circuit 94, and subsequently, at step 2315, the count value $CC_0$ is compared with the predetermined value $L_1$. The count value $CC_0$ corresponds to the rotation amount of the main motor 96, that is the feeding amount of the recording paper, and the predetermined value $L_1$ is a numerical value corresponding to the amount of movement when the tip end of the recording paper moves from the sheet paper detector 42 to the sheet paper detector 44. Namely, at step 2315, a time required for the tip end of the recording paper to reach the sheet paper detector 44 from the sheet paper detector 42 is measured. When the count value $CC_0$ is counted up to $L_1$ at step 2315, the routine proceeds to step 2316, at which the "ON"/"OFF" state of the sheet paper detector 44, that is, whether or not the output thereof is at the high level "H" or the low level "L". is decided. When the output of the sheet paper detector 44 is at the high level "H", that is, when it is confirmed that the tip end of the recording paper is detected by the sheet paper detector 44, the routine proceeds to step 2317, at which the counter circuit 178 is reset again.

At step 2318, the count value $CC_0$ is fetched from the counter circuit 178 into the control circuit 94 again, and subsequently, at step 2319, the count value $CC_0$ is compared with the predetermined value $L_2$. As mentioned above, the count value $CC_0$ corresponds to the feeding amount of the recording paper, and the predetermined value $L_2$ is a numerical value corresponding to the amount of movement when the recording paper passes the sheet paper detector 44. Namely, at step 2319, the time required for the recording paper to pass the sheet paper detector 44 is measured. When the count value $CC_0$ is counted up to $L_2$ at step 2319, the routine proceeds to step 2320, at which the "ON"/"OFF" state of the sheet paper detector 44, that is, whether or not the output thereof is at the high level "H" or the low level "L", is decided. When the output of the sheet paper detector 44 is at the low level "L", that is, when it is confirmed that the recording paper has passed the sheet paper detector 44, the routine proceeds to step 2321.

At step 2321, the detection temperature to is fetched from the temperature sensor 24 into the control circuit 94, and subsequently the detection temperature $t_0$ is compared with 200° C. at step 2322. Note that, it is not preferable in terms of safety that the detection temperature to of the temperature sensor 24, that is, the temperature at the position of the metal plate 22, becomes 200° C. or more. If $t_0$<200° C., the routine proceeds to step 2323, at which the detection temperature $tt_0$ is fetched from the temperature sensor 176 into the control circuit 94, and subsequently the detection temperature to is compared with 70° C. at step 2324. Note that, it should be avoided that the control circuit substrate 174 be exposed to an environment of 70° C. or more so as to maintain the operation reliability thereof. If $t_0$<70° C., the routine proceeds to step 2325.

At step 2325, it is decided whether or not the output of the sheet paper detector 40 is at the high level "H" or the low level "L". When the output of the sheet paper detector 40 is at the high level "H", that is, when the recording paper exists in the paper feed hopper 30, the routine is returned again to step 2305, at which a similar operation is repeated.

When the detection temperature $T_0$ of the temperature sensor 170 exceeds 290° C. at step 2308, the routine proceeds to step 2326, at which the detection temperature $T_0$ of the temperature sensor 170 is compared with for example 390° C. there. When $T_0$<390° C., the routine proceeds to step 2327, at which the main motor 96 is driven at the medium speed level. Subsequently, the routine proceeds to step 2310, at which the operation as mentioned above is sequentially carried out, but the main motor 96 is driven at the medium speed level, and therefore the erasing processing speed of the recording paper is made earlier. For example, where the recording paper is the A4 size, when the driving speed of the main motor 96 is the low speed level, the number of the erasing processed sheets is one per minute, but when the driving speed of the main motor 96 is at the medium speed level, the number of the erasing processed sheets per minute becomes three sheets.

When the detection temperature $T_0$ of the temperature sensor 170 exceeds 390° C. at step 2326, the routine proceeds to step 2328, at which the detection temperature $T_0$ of the temperature sensor 170 is compared with for example 410° C. When $T_0 \leqq 410°$ C., the routine proceeds to step 2329, at which the main motor 96 is driven at the high speed level. Subsequently, the routine proceeds to step 2310, at which the operation as mentioned above is sequentially carried out. Note that, when the main motor 96 is driven at the medium speed level, where the recording paper is the A4 size, the number of the erasing processed sheets per minute becomes five.

When the detection temperature $T_0$ of the temperature sensor 170 exceeds 410° C. at step 2328, the routine proceeds to step 2330, at which the cooling fan 28 is driven there, whereby the rising of temperature of the heat resistant glass plate 22 is prevented. After the driving of the cooling fan 28, the detection temperature $T_0$ is fetched from the temperature sensor 176 into the control circuit 94 at step 2331, and subsequently, at step 2332, the detection temperature $T_0$ is compared with for example 420° C. When $T_0 \leqq 420°$ C., the routine proceeds to step 2310, at which the operation as mentioned above is sequentially carried out.

When the temperature of the heat resistant glass plate 22 exceeds 430° C., the recording paper may be burnt and changed in color due to the heat. Accordingly, when the detection temperature $T_0$ of the temperature sensor 170 exceeds 420° C., which is slightly lower than 430° C., at step 2332, the routine proceeds to step 2333, at which the halogen lamp 12*b* is turned off. At step 2334, the detection temperature $T_0$ is fetched again from the temperature sensor 176 into the control circuit 94, and subsequently, at step 2334, the detection temperature $T_0$ is compared with for example 400° C. When $T_0$>400° C., the routine is returned to step 2333. Namely, at step 2335, it stands by until the temperature of the heat resistant glass plate 20 is lowered to 400° C. or less, and during this time, the erasing processing is interrupted. At step 2335, when the detection temperature to from the temperature sensor 170 becomes 400° C. or less, the routine proceeds to step 2336, at which the halogen lamp 12*b* is turned on again by the high level voltage, and subsequently the routine proceeds to step 2310, at which the erasing processing is restarted.

At step 2325, when the output of the sheet paper detector 40 is at the low level "L", that is, when a recording sheet does not exist in the paper feed hopper 30, the routine proceeds to step 2337, at which the halogen lamp 12*b* is turned off, and subsequently, the driving of the cooling fans 28 and 172 is stopped at step 2338. At step 2339, it is decided whether or not the predetermined time has elapsed. Note that, such a predetermined time is a sufficient time until the recording paper is ejected onto the ejected paper stacker 48 via the sheet paper eject opening 46 by the sheet paper feeding rollers 16 and 16. After an elapse of the predetermined time, the routine proceeds to step 2340, at which the driving of the main motor 96 is stopped, and, subsequently, the flag $F_1$ is rewritten to "0" at step 2329, and then the operation routine is ended. Note that, so as to actuate the erasing apparatus of FIG. 20 again, it is sufficient if the operation switch 192 is turned "ON", and when the preheating is to be carried out, it is sufficient if the preheating switch 190 is turned "ON".

When the output of the sheet paper detector 44 is at the low level "L" at step 2316, that is, when the tip end of the recording paper is not detected by the sheet paper detector 42 irrespective of the fact that the time required for the tip end of the recording paper to reach the sheet paper detector 44 from the sheet paper detector 42 has elapsed, it is considered that paper jamming occurred between the sheet paper detector 42 and the sheet paper detector 44, and therefore in this case, the routine proceeds to step 2342, at which the halogen lamp 12*b* is turned off, and subsequently, the routine proceeds to step 2343, at which the alarm display is carried out. Note that, such an alarm display can be carried out by a warning lamp or a liquid crystal display etc. provided in the operation panel of the erasing apparatus. After the alarm display, the routine proceeds to step 2340, at which the driving of the main motor 96 is stopped, and subsequently, the flag $F_1$ is rewritten to "0" at step 2329, and then the operation routine is ended.

Also, when the output of the sheet paper detector 44 is at the high level "H" at step 2320, that is, when the recording paper is being detected by the sheet paper detector 42 irrespective of the fact that the time required for the recording paper to pass the sheet paper detector 44 has elapsed, it is considered that paper jamming occurred in the passage on the heating and near IR irradiation unit 12, and therefore also in this case, the routine proceeds to step 2342, at which the above-mentioned operation is sequentially carried out.

Further, at step 2322, where the detection temperature to of the temperature detector 24 exceeds 200° C., it is considered that the temperature of the heat resistant glass plate 20 is 430° C. or more, and therefore also in this case, the routine proceeds to step 2342, and the above-mentioned operation is sequentially carried out. Note that, the temperature detector 24 acts as the auxiliary temperature detector, and even in a case where one of the two temperature detectors 24 and 170 malfunctions, the operation of the erasing apparatus can be safely stopped. On the other hand, when the detection temperature $tt_0$ from the temperature sensor 176 exceeds 70° C. at step 2324, the control circuit substrate 174 may be damaged, and therefore also in this case, the routine proceeds to step 2342, at which the above-mentioned operation is sequentially carried out.

When the output of the sheet paper detector 40 is at the low level "L" at step 2301, that is, when the recording paper is not mounted in the paper feed hopper 30, the routine proceeds to step 2344, at which after the error display is carried out, the operation routine is immediately ended. Note that, such an error display is carried out preferably by a liquid crystal display or the like provided in the operation panel of the erasing apparatus.

In the embodiment shown in FIG. 20 through FIG. 25, the erasing processing temperature is divided into three temperature ranges, that is, within a range of from 200° C. to 290° C., within a range of from 290° C. to 390° C., and within a range of from 290° C. to 410° C., and the number of processed sheets of recording paper per unit time (erasing processing speed) is made variable, but it should be understood that this temperature division is an example. Also, it is not always necessary to divide the erasing processing temperature into three temperature ranges. It is also possible even if it is divided into two temperature ranges, or it is also possible to divide the same into three or more temperature ranges and to further finely divide the number of processed sheets of the recording paper per unit time.

Note that, it is also possible to apply the point of monitoring the erasing processing temperature and a point of monitoring the temperature of the control circuit substrate using the auxiliary temperature detector to the erasing apparatuses shown in FIG. 2 and FIG. 18, respectively.

Figure 26:
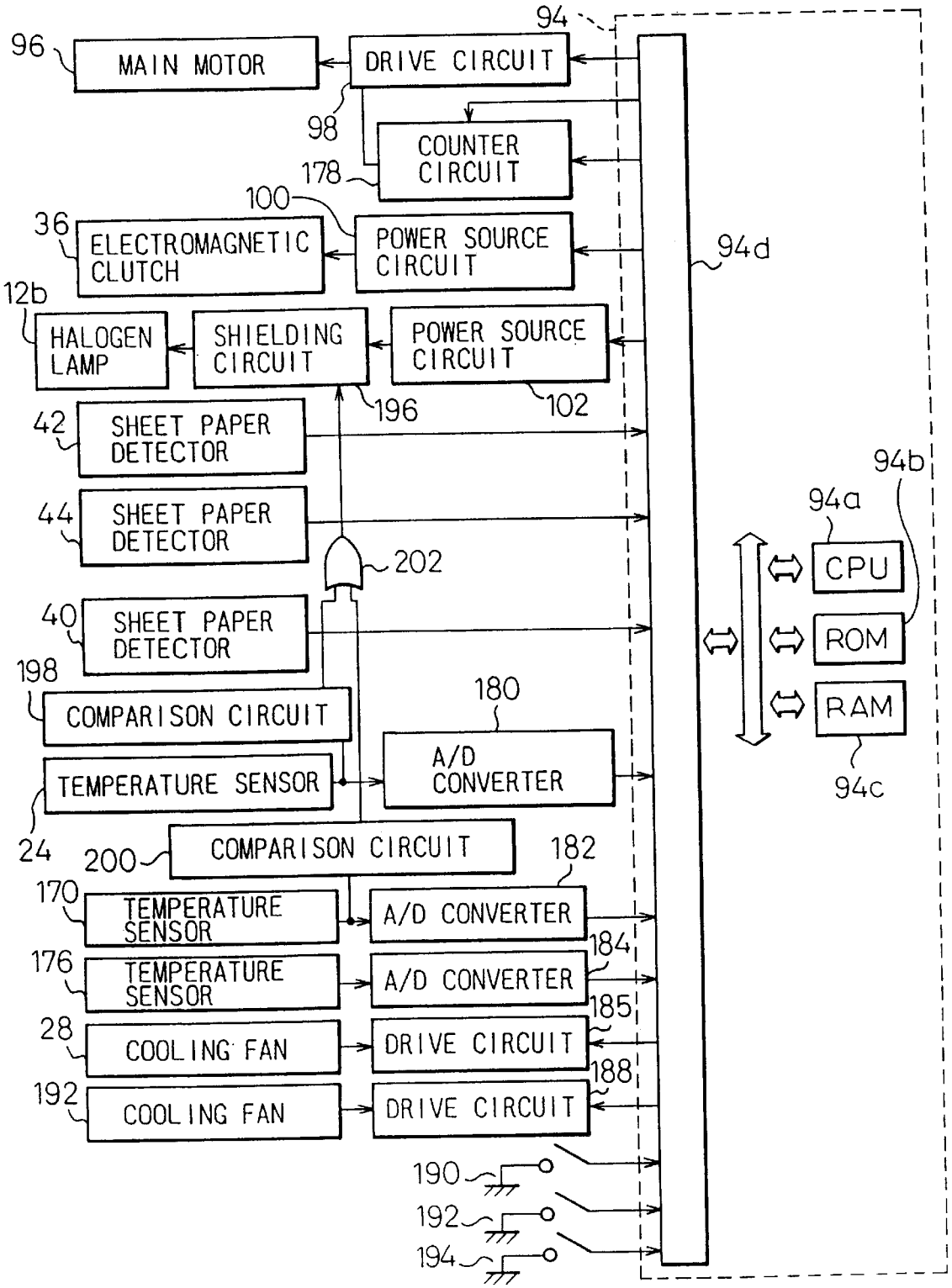
FIG. 26 is a block diagram of the control of the erasing apparatus of FIG. 20.

FIG. 26 shows a modified embodiment of a block diagram of control shown in FIG. 21. In this modified embodiment, the safety during the erasing processing operation is further enhanced. Explaining this in detail, a shielding circuit 196 is interposed between the halogen lamp 12*b* and the power source circuit 102 thereof, and comparison circuits 198 and 200 are connected to the respective output lines of the temperature sensors 24 and 170. These comparison circuits 198 and 200 are connected via the OR circuit 202 to the shielding circuit 196. The reference voltage of the comparison circuit 198 is set up as the output voltage when the temperature sensor 24 detects the temperature of 200° C., and when the output voltage of the temperature sensor 24 is such a reference voltage or less (that is, when the temperature sensor 24 detects the temperature of 200° C. or less), the output signal from the comparison circuit 198 is at the low level "L", but when the output voltage of the temperature sensor 24 exceeds such a reference voltage (that is when the temperature sensor 24 detects the temperature of 200° C. or more), the output signal from the comparison circuit 198 is switched from the low level "L" to the high level "H". Also, the reference voltage of the comparison circuit 200 is set up as the output voltage when the temperature sensor 170 detects the temperature of 420° C., and when the output voltage of the temperature sensor 170 is such a reference voltage or less (that is, when the temperature sensor 170 detects the temperature of 420° C. or less), the output signal from the comparison circuit 200 is at the low level "L", but when the output voltage of the temperature sensor 170 exceeds such a reference voltage (that is when the temperature sensor 170 detects the temperature of 420° C. or more), the output signal from the comparison circuit 200 is switched from the low level "L" to the high level "H". Accordingly, when the output signal of either one of the comparison circuits 198 and 200 becomes the high level "H", the output signal from the OR circuit 202 is switched from the low level "L" to the high level "H", and at this time, the shielding circuit 196 is activated, so that the connection between the halogen lamp 12*b* and the power source circuit 102 thereof is cut. According to such a structure, the control system comprising the shielding circuit 196, the comparison circuits 198 and 200 and the OR circuit 202 is independent from the control circuit 94, and therefore even if a trouble occurs in the control circuit 94 during the erasing processing operation, the halogen lamp 12*b* can be turned off, and therefore the internal temperature of the erasing apparatus will not abnormally rise. Note that, it goes without saying that such a consideration can be applied similarly also to the block diagram of control shown in FIG. 6.

Figure 27:
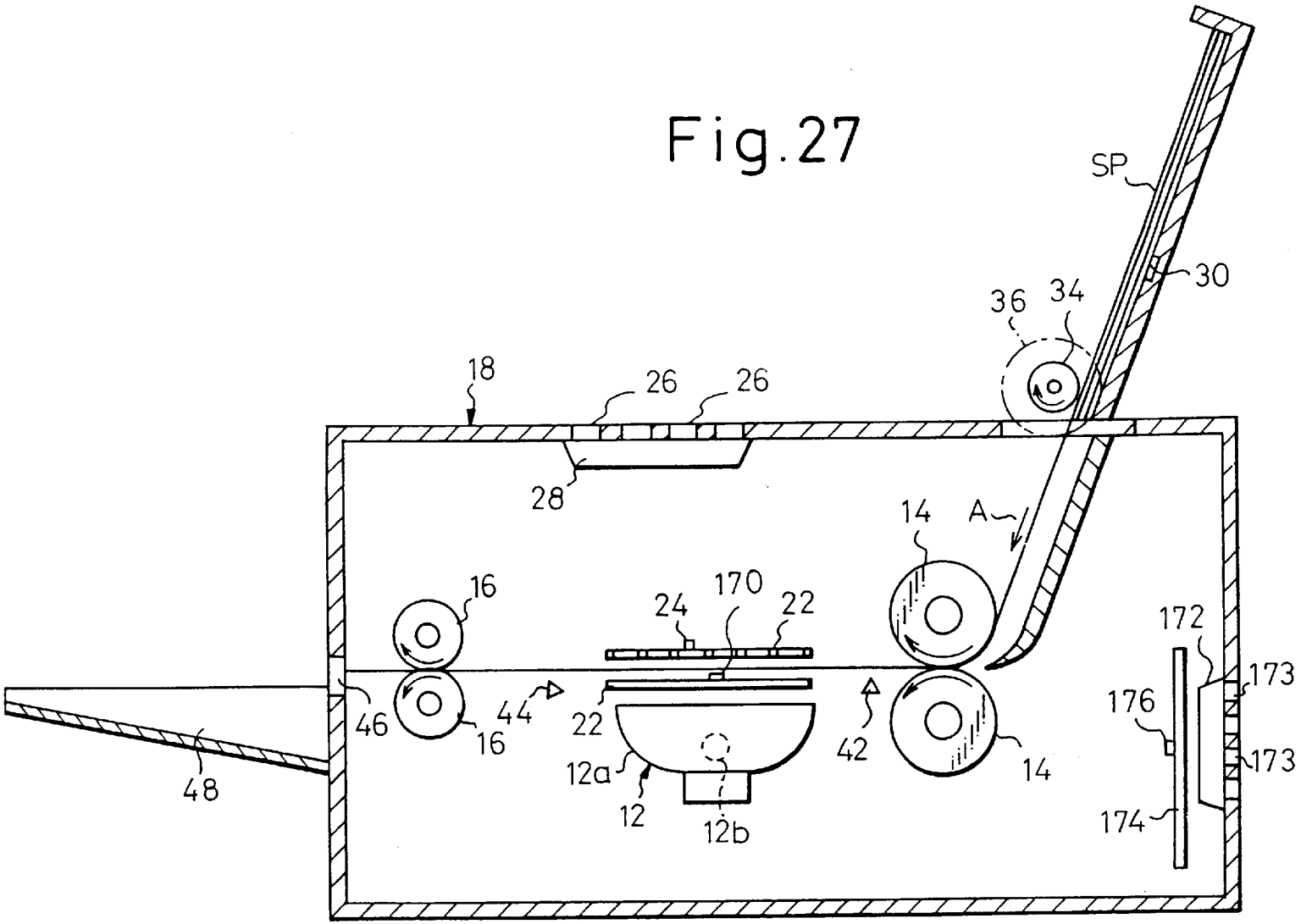
FIG. 27 is a schematic view showing another preferred embodiment of the erasing apparatus constituted according to the second aspect of the present invention.

FIG. 27 shows a preferred embodiment of the erasing apparatus constituted according to the second aspect of the present invention, which embodiment is basically the same as the erasing apparatus shown in FIG. 18, but also in the embodiment of FIG. 27, the erasing processing can be quickly and efficiently carried out in comparison with the embodiment of FIG. 2 in the same way as the erasing apparatus shown in FIG. 20. In summary, the erasing apparatus of FIG. 27 corresponds to one obtained by omitting the liquid-state catalyst coating unit 10 from the erasing apparatus of FIG. 20. In FIG. 27, the same reference numerals are used for the constituent elements similar to those of the erasing apparatus of FIG. 20. Moreover, also the operation of the erasing apparatus of FIG. 27 can be explained by the same mode as the case of the erasing apparatus of FIG. 20.

Figure 28:
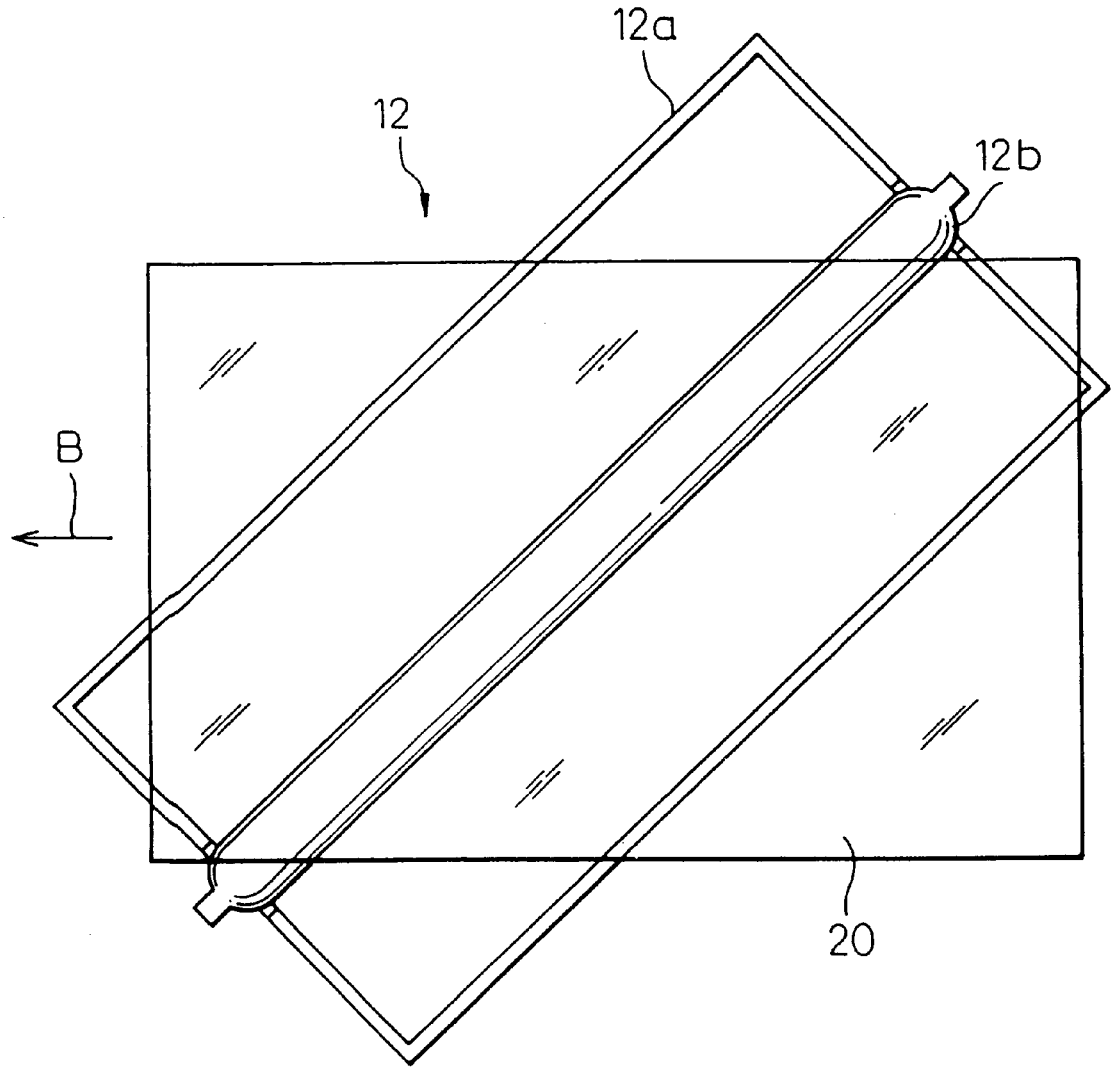
FIG. 28 is a plan view showing a preferred embodiment of the heating and near IR irradiation unit.

FIG. 28 shows a preferred embodiment of the heating and near IR irradiation unit 12. In this embodiment, the length of the halogen lamp 12*b* is made greater than the width of the heat resistant glass plate, and in addition, arranged with an inclination relative to the feeding direction of the recording paper indicated by an arrow B. In this case, as is illustrated, also the reflecting concave surface mirror portion 12*a* is inclined in the same way as the halogen lamp 12*b*. According to such a structure, the amount of irradiation of near infrared rays with respect to the recording surface of the recording paper is increased, whereby the enhancement of efficiency of the erasing processing can be achieved.

Figure 29:
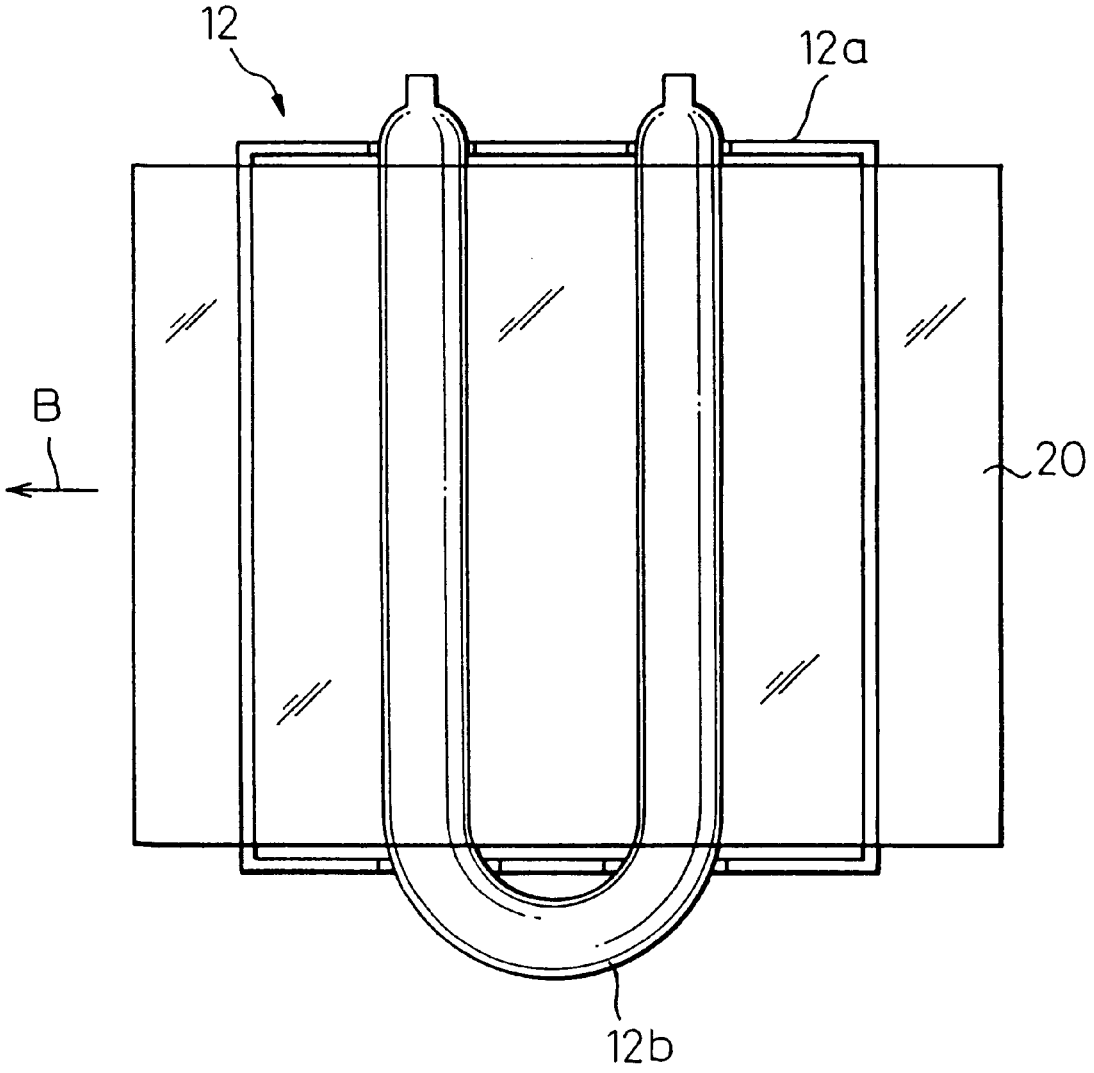
FIG. 29 is a plan view showing another preferred embodiment of the heating and near IR irradiation unit.

FIG. 29 shows another preferred embodiment of the heating and near IR irradiation unit 12. In this embodiment, a halogen lamp 12*b* having a U-shape is accommodated in the reflecting concave surface mirror portion 12*a*, and the recording paper is made to pass above the heat resistant glass plate 20 in the direction indicated by the arrow B. By using the halogen lamp 12*b* of a U-shape, the near IR irradiation region on the heat resistant glass plate 20 is enlarged, whereby the enhancement of efficiency of the erasing processing can be attempted.

Figure 30:
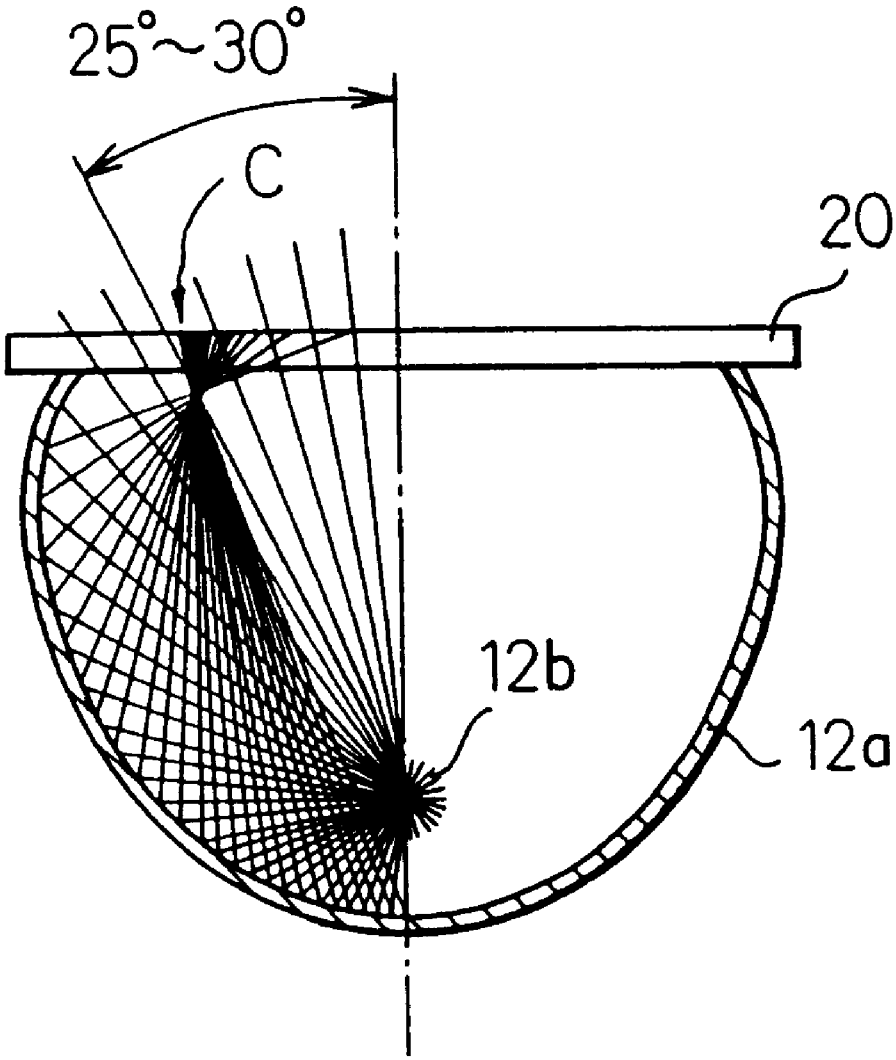
FIG. 30 is a plan view showing still another preferred embodiment of the heating and near IR irradiation unit.

FIG. 30 shows a still another preferred embodiment of the heating and near IR irradiation unit 12, which embodiment is formed so that the reflecting surface of respective one sides of the reflecting concave surface mirror portions 12*a*, that is, of one sides divided by axial lines of longitudinal direction thereof exhibit focusing functions independent from each other. Explaining this in detail, as shown in FIG. 30, the light emitted from a left half of the halogen lamp 12*b* and incident upon the left side reflecting surface of the reflecting concave surface mirror portion 12*a* is focused at the position indicated by a reference symbol C (that is, substantially center position of the left side half of the heat resistant glass plate 20), and the same is true also for the right side reflecting surface of the reflecting concave surface mirror portion 12*a*. Also according to such a structure, the near IR irradiation region on the heat resistant glass plate 20 is enlarged, whereby the enhancement of efficiency of the erasing processing can be achieved. Note that, it is possible to make the surface passing through the axial line in the longitudinal direction of the halogen lamp 12*a* and the focused position C to exhibit an angle of 25 to 30° relative to the vertical surface passing through the axial line in the longitudinal direction of the halogen lamp 12.

As apparent from the above disclosure, according to the present invention, it is possible to smoothly and reliably perform the erasing processing of the recording agent on the recording medium, and therefore the efficiency of the reuse of the recording paper can be enhanced. Also, according to the first aspect of the present invention, it is assumed that the recording is carried out on the recording medium by a non-catalyst-containing recording agent composed of a near IR erasable dye, and therefore the concentration of this type of recording agent of a recording medium is maintained stably for a long period, and thus the persistency thereof is greatly enhanced. Also, according to the second aspect of the present invention, the heating and irradiation of near infrared rays with respect to the recording medium can be simultaneously carried out at the time of erasing processing using the thermal emission and near IR irradiation source, and therefore that erasing apparatus can be provided at low cost.

Finally, it will be understood by those skilled in the art that foregoing description is of preferred embodiments of the disclosed apparatuses, and that various changes and modifications may be made to the present invention without departing from the spirit and scope thereof.

What is claimed is:

1. A method of erasing a recording agent on a recording surface of a recording medium recorded by a catalyst-containing recording agent comprising a near IR erasable dye, said method comprising the steps of:

feeding the recording medium along a feeding path with respect to a thermal emission and near IR irradiation source such that a heating of the recording medium and an irradiation of near infrared rays onto the recording surface of the recording medium are simultaneously carried out by said thermal emission and near IR irradiation source; and varying a feeding speed of the recording medium in accordance with a temperature change of said feeding path, a temperature of said feeding path being controlled to be within a temperature range from approximately 200° C. through 410° C.

2. A method as set forth in claim 1, wherein said thermal emission and near IR irradiation source comprises one of a halogen lamp and a metal halide lamp.

3. An erasing apparatus for erasing a recording agent on a recording surface of a recording medium recorded by a recording agent comprising a near IR-erasable dye, said apparatus comprising:

liquid-state catalyst coating means for coating a liquid-state catalyst on the recording surface of the recording medium; and erasing processing means for heating the recording medium on which the liquid-state catalyst is coated by said liquid-state catalyst coating means, and for irradiating the near infrared rays onto the recording surface of said recording medium, thereby erasing the recording agent of said recording surface wherein;

said liquid-state catalyst coating means and said erasing processing means are disposed alone a feeding path (P) through which the recording medium is unidirectionally fed, and wherein said liquid-state catalyst coating means is positioned at an upstream side of said erasing processing means;

a feeding speed of the recording medium is changed in accordance with a temperature change of the feeding path; and a temperature of the feeding path is controlled to be within a temperature range from approximately 200° C. to 410° C.

4. An erasing apparatus as set forth in claim 3, wherein said erasing processing means comprises heating and near IR irradiation means for simultaneously heating of the recording medium and the irradiation of the near infrared rays onto the recording surface of said recording medium.

5. An erasing apparatus as set forth in claim 4, wherein said heating and near IR irradiation means comprises a thermal emission and near IR irradiation source.

6. An erasing apparatus as set forth in claim 5, wherein said thermal emission and near IR irradiation source comprises a thin and long shape longer than a width of said feeding path (P) and is disposed at an incline relative to said feeding path (P).

7. An erasing apparatus as set forth in claim 5, wherein said thermal emission and near IR irradiation source comprises a U-shape and two ends of the U-shape are positioned on one side of said feeding path (P).

8. An erasing apparatus as set forth in claim 5, wherein said heating and near IR irradiation means comprises a reflecting concave surface mirror member accommodating the thermal emission and near IR irradiation source, and wherein a reflecting surface of the reflecting concave surface mirror member is formed to give two focusing positions on said feeding path (P).

9. An erasing apparatus as set forth in claim 5, wherein said thermal emission and near IR irradiation source comprises one of a halogen lamp and a metal halide lamp.

10. An erasing apparatus as set forth in claim 4, wherein said heating and near IR irradiation means comprises a light transmitting plate element providing said feeding path (P), and wherein the heating and irradiation of the near infrared rays from said heating and near IR irradiation means to said feeding path (P) are carried out through said light transmitting plate element.

11. An erasing apparatus as set forth in claim 4, wherein said heating and near IR irradiation means comprises:

a cylindrical light transmitting roller element by which said heating and near IR irradiation means becomes able to freely rotate;

a thermal emission and near IR irradiation source disposed inside of said cylindrical light transmitting roller element; and a pressing element which is engaged with said cylindrical light transmitting roller element, the recording medium passing between said cylindrical light transmitting roller element and said pressing element, and the heating and the irradiation of near infrared rays from said heating and near IR irradiation means to said feeding path (P) being carried out through said cylindrical light transmitting roller element.

12. An erasing apparatus as set forth in claim 3, wherein a heat insulating and shielding plate element is provided between said liquid-state catalyst coating means and said erasing processing means.

13. An erasing apparatus as set forth in claim 3, wherein said liquid-state catalyst coating means comprises a retaining tank which retains the liquid-state catalyst and roller assemblies arranged inside the retaining tank, said roller assemblies comprising at least a liquid-state catalyst in said retaining tank therewith and a backup roller engaged with the liquid-state catalyst coating roller, wherein when the recording medium passes between two of the rollers, the liquid-state catalyst is coated on the recording surface of said recording medium by said liquid-state catalyst coating roller.

14. An erasing apparatus as set forth in claim 13, wherein water repellent processing for preventing adhesion of the liquid-state catalyst from said liquid-state catalyst coating roller is applied to said backup roller.

15. An erasing apparatus as set forth in claim 13, wherein said roller assemblies further comprise a liquid-state catalyst feed roller engaged with said liquid-state catalyst coating roller to supply the liquid-state catalyst to said liquid-state catalyst coating roller and, at the same time, partially dipped in the liquid-state catalyst inside said retaining tank, wherein the liquid-state catalyst feed roller freely displaces so that the liquid-state catalyst feed roller can adjust a nip width relative to said liquid-state catalyst coating roller for adjusting an amount of supply of the liquid-state catalyst to said liquid-state catalyst coating roller.

16. An erasing apparatus as set forth in claim 3, further comprising:

temperature detection means provided at an appropriate position to detect a temperature exerted from said erasing processing means upon said feeding path (P);

temperature determination means for determining whether the temperature detected by said temperature detection means exceeds a first temperature; and heating stopping means for stopping the heating to said feeding path (P) by said erasing processing means when said temperature determination means determines that the temperature detected by said temperature detection means exceeds the first temperature.

17. An erasing apparatus as set forth in claim 16, further comprising:

auxiliary temperature determination means for determining whether the temperature detected by said temperature detection means exceeds the first temperature; and auxiliary heating stopping means for stopping the heating to said feeding path (P) by said erasing processing means when said auxiliary temperature determination means determines that the temperature detected by said temperature detection means exceeds the first temperature, wherein a control system comprising said temperature determination means and said heating stopping means is independent from a control system comprising said auxiliary temperature determination means and said auxiliary heating stopping means.

18. An erasing apparatus as set forth in claim 5, further comprising:

first temperature detection means provided at an appropriate position to detect the temperature exerted from said erasing processing means upon said feeding path (P);

second temperature detection means provided at another position to detect the temperature exerted from said erasing processing means upon said feeding path (P);

first temperature determination means for determining whether the temperature detected by said first temperature detection means exceeds the first temperature;

second temperature determination means for determining whether the temperature detected by said second temperature detection means exceeds the first temperature;

first heating stopping means for stopping the heating to said feeding path (P) by said erasing processing means when said first temperature determination means determines that the temperature detected by said first temperature detection means exceeds the first temperature; and second heating stopping means for stopping the heating to said feeding path (P) by said erasing processing means when said second temperature determination means determines that the temperature detected by said second temperature detection means exceeds the first temperature.

19. An erasing apparatus as set forth in claim 18, further comprising:

first auxiliary temperature determination means determining whether the temperature detected by said first temperature detection means exceeds the first temperature;

second auxiliary temperature determination means for determining whether the temperature detected by said second temperature detection means exceeds the first temperature; and auxiliary heating stopping means for stopping the heating to said feeding path (P) by said erasing processing means one of when said first auxiliary temperature determination means determines that the temperature detected by said first temperature detection means exceeds the first temperature, and when said second auxiliary temperature determination means determines that the temperature detected by said second temperature detection means exceeds the first temperature, wherein a control system including said first temperature determination means, second temperature determination means, said first heating stopping means, and second heating stopping means is independent from a control system comprising said first auxiliary temperature determination means, second auxiliary temperature determination means, and said auxiliary heating stopping means.

20. An erasing apparatus as set forth in claim 5, further comprising:

temperature detection means attached to said control circuit board for detecting the temperature exerted upon the control circuit substrate controlling an erasing processing operation;

temperature determination means for determining whether the temperature detected by said temperature detection means exceeds the first temperature.

21. An erasing apparatus as set forth in claim 5, further comprising:

recording medium passing determination means for determining whether said recording medium passed a position at which said erasing processing means is disposed when feeding the recording medium along said feeding path (P); and stopping means for stopping the heating to said feeding path (P) by said erasing processing means when said recording medium passing determination means determines that the recording medium has not passed the position at which said erasing processing means is disposed.

22. An erasing apparatus as set forth in claim 3, further comprising:

evaluation means for evaluating an erasing state of the recording surface of the recording medium passing the position at which said erasing processing means is disposed;

first recording medium eject means for ejecting the recording medium to outside of the erasing apparatus when said evaluation means determines that the erasing state of the recording medium is good; and second recording medium eject means for ejecting the recording medium to the outside of the erasing apparatus when said evaluation means determines that the erasing state of the recording medium is not good.

23. An erasing apparatus as set forth in claim 22, further comprising marking means for giving an appropriate mark to said recording medium to indicate that the recording medium ejected by said first recording medium eject means is a reused recording medium.

24. An erasing apparatus as set forth in claim 3, further comprising:

evaluation means for evaluating the erasing state of the recording medium passing the position at which said erasing processing means is disposed; and recording medium returning means for returning said recording medium to said erasing processing means when said evaluation means determines that the erasing state of the recording surface of the recording medium is not good and for applying the erasing processing again to said recording medium.

25. An erasing apparatus as set forth in claim 24, further comprising at least command means for commanding a raise of the amount of irradiation of the near infrared rays from said erasing processing means to the recording medium by exactly a first amount when the recording medium is returned to said erasing processing means by said recording medium returning means.

26. An erasing apparatus as set forth in claim 24, further comprising at least raising means for raising the amount of irradiation of the near infrared rays from said erasing processing means to the recording medium by exactly a first amount when the recording medium is returned to said erasing processing means by said recording medium returning means.

27. An erasing apparatus as set forth in claim 24, further comprising:

first recording medium eject means for ejecting the recording medium to an outside of the erasing apparatus when said evaluation means determines that the erasing state of the recording medium is good;

counting means for counting a number of times of determination by said evaluation means that the erasing state is not good for the recording medium; and second recording medium eject means for ejecting the recording medium to the outside of the erasing apparatus irrespective of the evaluation of said evaluation means when the number of times counted by said counting means becomes at least a first number of times.

28. An erasing apparatus as set forth in claim 27, further comprising marking means for giving an appropriate mark to said recording medium to indicate that the recording medium ejected by said first recording medium eject means is a reused recording medium.

29. An erasing apparatus as set forth in claim 3, further comprising:

temperature detection means, provided at an appropriate position, for detecting the temperature exerted from said erasing processing means upon said feeding path (P);

temperature change determination means for determining whether the temperature detected by said temperature detection means is included in at least one of at least two temperature divided ranges; and feeding speed changing means for changing a feeding speed of the recording medium in accordance with the determination by said temperature change determination means.

30. An erasing apparatus as set forth in claim 29, further comprising cooling means for lowering the temperature which should be detected by said temperature detecting means when said temperature determination means determines that the temperature detected by said temperature detection means exceeds a temperature classification range on the high temperature side between said at least two temperature classification ranges.

31. An erasing apparatus as set forth in claim 22, further comprising preheating means for preheating said feeding path (P) by applying an electrical energy of a low level to said erasing processing means.

32. An erasing apparatus as set forth in claim 31, further comprising preheating selection means for selectively operating said preheating means.

33. An erasing apparatus for erasing a recording agent on the recording surface of a recording medium recorded by a catalyst-containing recording agent composed of a near IR-erasable dye said apparatus comprising:

a feeding path for feeding the recording medium in a direction;

heating and near IR irradiation means for simultaneously performing a heating of the recording medium and an irradiation of near infrared rays to the recording surface of said recording medium, said heating and near IR irradiation means being disposed along said feeding path;

temperature detection means, provided at an appropriate position, for detecting a temperature of heat transferred from said heating and near IR irradiation means to said feeding path;

temperature determination means for determining whether the temperature detected by said temperature detection means exceeds a first temperature; and heating stopping means for stopping the heat transferred to said feeding path by said heating and near IR irradiation means when said temperature determining means determines that the temperature detected by said temperature detection means exceeds the first temperature, wherein a feeding speed of the recording medium is changed in accordance with a temperature change of the feeding path and wherein the temperature of the feeding path is controlled to be within a temperature range from approximately 200° C. to 410° C.

34. An erasing apparatus as set forth in claim 33, wherein said heating and near IR irradiation means comprises a thermal emission and near IR irradiation source.

35. An erasing apparatus as set forth in claim 34, wherein said thermal emission and near IR irradiation source comprises a thin and long shape longer than a width of said feeding path (P) and is disposed at an incline relative to said feeding path (P).

36. An erasing apparatus as set forth in claim 34, wherein said thermal emission and near IR irradiation source comprises a U-shape and two ends of the U-shape are positioned on one side of said feeding path (P).

37. An erasing apparatus as set forth in claim 34, wherein said heating and near IR irradiation means comprises a reflecting concave surface mirror member accommodating the thermal emission and near IR irradiation source, and a reflecting surface of the reflecting concave surface mirror member is formed to give two focal positions on said feeding path (P).

38. An erasing apparatus as set forth in claim 34, wherein said thermal emission and near IR irradiation source comprises one of a halogen lamp and a metal halide lamp.

39. An erasing apparatus as set forth in claim 33, wherein:

said heating and near IR irradiation means is disposed along the feeding path (P) of feeding the recording medium in one direction, said heating and near IR irradiation means comprises a light transmitting plate element providing said feeding path (P), and the heating and the irradiation of the near infrared rays from said heating and near IR irradiation means to said feeding path (P) are carried out through said light transmitting plate element.

40. An erasing apparatus as set forth in claim 33, wherein said heating and near IR irradiation means is disposed along the feeding path (P) of feeding the recording medium in one direction and wherein said heating and near IR irradiation means comprises:

a cylindrical light transmitting roller element by which said heating and near IR irradiation means becomes able to freely rotate;

a thermal emission and near IR irradiation source disposed inside of said cylindrical light transmitting roller element; and a pressing element engaged with said cylindrical light transmitting roller element, the recording medium being made to pass between said cylindrical light transmitting roller element and said pressing element, and the heating and irradiation of the near infrared rays from said heating and near IR irradiation means to said feeding path (P) being carried out through said cylindrical light transmitting roller element.

41. An erasing apparatus as set forth in claim 33, wherein said heating and near IR irradiation means is disposed along the feeding path (P) of feeding the recording medium in one direction, said erasing apparatus further comprising:

auxiliary temperature determination means for determining whether the temperature detected by said temperature detection means exceeds the first temperature; and auxiliary heating stopping means for stopping the heating to said feeding path (P) by said heating and near IR irradiation means when said auxiliary temperature determination means determines that the temperature detected by said temperature detection means exceeds the first temperature, wherein a control system comprising said temperature determination means and said heating stopping means is independent from a control system comprising said auxiliary temperature determination means and said auxiliary heating stopping means.

42. An erasing apparatus as set forth in claim 33, wherein said heating and near IR irradiation means is disposed along the feeding path (P) of feeding the recording medium in one direction, said erasing apparatus further comprising:

first temperature detection means provided at an appropriate position for detecting the temperature exerted from said heating and near IR irradiation means upon said feeding path (P);

second temperature detection means provided at another position for detecting the temperature exerted from said heating and near IR irradiation means upon said feeding path (P);

first temperature determination means for determining whether the temperature detected by said first temperature detection means exceeds the first temperature;

second temperature determination means for determining whether the temperature detected by said second temperature detection means exceeds the first temperature;

first heating stopping means for stopping the heating to said feeding path (P) by said heating and near IR irradiation means when said first temperature determination means determines that the temperature detected by said first temperature detection means exceeds the first temperature; and second heating stopping means for stopping the heating to said feeding path (P) by said heating and near IR irradiation means when said second temperature determination means determines that the temperature detected by said second temperature detection means exceeds the first temperature.

43. An erasing apparatus as set forth in claim 42, further comprising:

first auxiliary temperature determination means for determining whether the temperature detected by said first temperature detection means exceeds the first temperature;

second auxiliary temperature determination means for determining whether the temperature detected by said second temperature detection means exceeds the first temperature; and auxiliary heating stopping means for stopping the heating to said feeding path (P) by said heating and near IR irradiation means one of when said first auxiliary temperature determination means determines that the temperature detected by said first temperature detection means exceeds the first temperature and when said second auxiliary temperature determination means determines that the temperature detected by said second temperature detection means exceeds the first temperature, wherein a control system comprising said first temperature determination means, said second temperature determination means, said first heating stopping means, and second heating stopping means is independent from a control system comprising said first auxiliary determination means, said second auxiliary temperature determination means, and said auxiliary heating stopping means.

44. An erasing apparatus as set forth in claim 33, wherein said heating and near IR irradiation means is disposed along the feeding path (P) of feeding the recording medium in one direction.

45. An erasing apparatus as set forth in claim 33, wherein said heating and near IR irradiation means is disposed along the feeding path (P) of feeding the recording medium in one direction, said erasing apparatus further comprising:

recording medium passing determination means for determining whether said recording medium passes a position at which said heating and near IR irradiation means is disposed when feeding the recording medium along said feeding path (P); and stopping means for stopping the heating to said feeding path (P) by said heating and near IR irradiation means when said recording medium passing determination means determines that the recording medium has not passed the position at which said heating and near IR irradiation means is disposed.

46. An erasing apparatus as set forth in claim 33, wherein said heating and near IR irradiation means is disposed along the feeding path (P) of feeding the recording medium in one direction, said erasing apparatus further comprising:

evaluation means for evaluating an erasing state of the recording surface of the recording medium passing the position at which said heating and near IR irradiation means is disposed;

first recording medium eject means for ejecting the recording medium to outside of the erasing apparatus when said evaluation means determines that the erasing state of the recording medium is good; and second recording medium eject means for ejecting the recording medium to the outside of the erasing apparatus when said evaluation means determines that the erasing state of the recording medium is not good.

47. An erasing apparatus as set forth in claim 46, further comprising marking means for giving an appropriate mark to said recording medium to indicate that the recording medium ejected by said first recording medium eject means is a reused recording medium.

48. An erasing apparatus as set forth in claim 33, wherein said heating and near IR irradiation means is disposed along the feeding path (P) of feeding the recording medium in one direction, said erasing apparatus further comprising:

evaluation means for evaluating an erasing state of the recording surface of the recording medium passing a position at which said heating and near IR irradiation means is disposed; and recording medium returning means for returning said recording medium to said heating and near IR irradiation means when said evaluation means determines that an erasing state of the recording surface of the recording medium is not good and for applying the erasing processing again to said recording medium.

49. An erasing apparatus as set forth in claim 48, further comprising at least command means for commanding a raise of an amount of irradiation of the near infrared rays from said heating and near IR irradiation means to the recording medium by exactly a first amount when the recording medium is returned to said heating and near IR irradiation means by such recording medium returning means.

50. An erasing apparatus as set forth in claim 48, further comprising at least raising means for raising an amount of irradiation of the near infrared rays from said heating and near IR irradiation means to the recording medium by exactly a first amount when the recording medium is returned to said heating and near IR irradiation means by said recording medium returning means.

51. An erasing apparatus as set forth in claim 48, further comprising:

first recording medium eject means for ejecting the recording medium to the outside of the erasing apparatus when said evaluation means determines that the erasing state of the recording medium is good;

counting means for counting a number of times of determination by said evaluation means that the erasing state is not good for the recording medium; and second recording medium eject means for ejecting the recording medium to the outside of the erasing apparatus irrespective of an evaluation of said evaluation means when the number of times counted by said counting means becomes at least the first number of times.

52. An erasing apparatus as set forth in claim 51, further comprising marking means for giving an appropriate mark to said recording medium to indicate that the recording medium ejected by said first recording medium eject means is a reused recording medium.

53. An erasing apparatus as set forth in claim 33, wherein said heating and near IR irradiation means is disposed along the feeding path (P) of feeding the recording medium in one direction, said erasing apparatus further comprising:

temperature change determination means for determining whether the temperature detected by said temperature detection means is included in the at least two temperature classification ranges; and feeding speed changing means for changing a feeding speed of the recording medium in accordance with the determination by said temperature change determination means.

54. An erasing apparatus as set forth in claim 53, further comprising cooling means for lowering the temperature to be detected by said temperature detection means when said temperature determination means determines that the temperature detected by said temperature detection means exceeds a temperature classification range on a high temperature side between the at least two temperature classification ranges.

55. An erasing apparatus as set forth in claim 33, further comprising preheating means for preheating said feeding path (P) by applying an electrical energy of a low level to said heating and near IR irradiation means.

56. An erasing apparatus as set forth in claim 55, further comprising preheating selection means for selectively operating said preheating means.

57. A portable erasing apparatus for erasing a recording agent on a recording medium recorded by the recording agent comprising a near IR erasable dye, said apparatus comprising:

a feeding path for feeding the recording medium in a direction;

casing means;

liquid-state catalyst coating means, provided in a part of said casing means, for coating a liquid-state catalyst on the recording surface of said recording medium; and heating and near IR irradiation means, provided in a part of said casing means, for heating the recording surface of the recording medium coated with the liquid-state catalyst by said liquid-state catalyst coating means, and for irradiating near infrared rays onto said recording surface, wherein the feeding speed of the recording medium is changed in accordance with a temperature change of the feeding path and wherein the temperature of the feeding path is controlled to be within a temperature range from approximately 200° C. to 410° C.

58. A portable erasing apparatus as set forth in claim 57, wherein said heating and near IR irradiation means comprises one of a halogen lamp and a metal halide lamp as the thermal emission and near IR irradiation source.

59. A portable erasing apparatus as set forth in claim 56, wherein said casing means comprises a shape of a long writing tool having two sides and wherein said liquid-state catalyst coating means and said heating and near IR irradiation means are provided on the two sides, respectively.

60. A portable erasing apparatus as set forth in claim 58, further comprising a cap element detachably mounted on a corresponding end portion of said casing means to cover said liquid-state catalyst coating means.

* * * * *

UNITED STATES PATENT AND TRADEMARK OFFICE

CERTIFICATE OF CORRECTION

PATENT NO.: 6,071,352
DATED : June 6, 2000
INVENTOR(S): Masaru SUGIE et al.

It is certified that error appears in the above-identified patent and that said Letters Patent is hereby corrected as shown below:

On the title page, block [75], change each occurrence of "Inagi" to --Tokyo--.

Col. 29, line 47, after "surface" insert --,--.

Col. 37, line 23, change "such" to --said--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*